US009471021B2

(12) United States Patent
Tosaka et al.

(10) Patent No.: US 9,471,021 B2
(45) Date of Patent: Oct. 18, 2016

(54) APPARATUS AND METHOD FOR FORMING IMAGE

(71) Applicants: Akihiko Tosaka, Kanagawa (JP); Toshiyuki Uchida, Kanagawa (JP); Kazuhiro Kobayashi, Kanagawa (JP); Hiroaki Murakami, Kanagawa (JP)

(72) Inventors: Akihiko Tosaka, Kanagawa (JP); Toshiyuki Uchida, Kanagawa (JP); Kazuhiro Kobayashi, Kanagawa (JP); Hiroaki Murakami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/732,127

(22) Filed: Jun. 5, 2015

(65) Prior Publication Data

US 2015/0362881 A1 Dec. 17, 2015

(30) Foreign Application Priority Data

Jun. 11, 2014 (JP) ..... 2014-120930

(51) Int. Cl.
*G03G 15/00* (2006.01)

(52) U.S. Cl.
CPC .. *G03G 15/5058* (2013.01); *G03G 2215/0132* (2013.01); *G03G 2215/0161* (2013.01)

(58) Field of Classification Search
CPC ..... G03G 15/5054; G03G 15/5058; G03G 2215/0132; G03G 2215/0161
See application file for complete search history.

(56) References Cited

U.S. PATENT DOCUMENTS

| | | | | |
|---|---|---|---|---|
| 5,946,529 | A | 8/1999 | Sato et al. | |
| 2004/0165025 | A1* | 8/2004 | Ishibashi | H04N 1/00002 347/19 |
| 2005/0212887 | A1* | 9/2005 | Tanaka | G03G 15/0131 347/116 |
| 2006/0222418 | A1 | 10/2006 | Ebara et al. | |
| 2007/0097465 | A1 | 5/2007 | Kobayashi et al. | |
| 2008/0166153 | A1 | 7/2008 | Ehara et al. | |
| 2008/0213000 | A1 | 9/2008 | Funamoto et al. | |
| 2010/0266299 | A1 | 10/2010 | Funamoto et al. | |
| 2010/0303504 | A1 | 12/2010 | Funamoto et al. | |
| 2011/0150531 | A1 | 6/2011 | Kobayashi et al. | |
| 2012/0008993 | A1* | 1/2012 | Maeda | G03G 15/0131 399/301 |
| 2012/0207501 | A1 | 8/2012 | Funamoto et al. | |
| 2016/0098005 | A1 | 4/2016 | Kobayashi et al. | |

FOREIGN PATENT DOCUMENTS

| | | |
|---|---|---|
| JP | 2006-293240 | 10/2006 |
| JP | 2014-021242 | 2/2014 |

* cited by examiner

*Primary Examiner* — Matthew G Marini
(74) *Attorney, Agent, or Firm* — Oblon, McClelland, Maier & Neustadt, L.L.P

(57) ABSTRACT

An image forming apparatus includes a multi-color misalignment calculator that calculates an amount of multi-color misalignment of multiple color misalignment detection test pattern images based on position readings outputted by multiple test pattern image detectors, an image formation condition adjusting unit that adjusts an image formation condition of the image forming apparatus in accordance with the amount of multi-color misalignment of the multiple color misalignment detection test pattern images calculated by the multi-color misalignment calculator, and a process control unit that initiates a first multi-color misalignment correction control mode including a skew misalignment correction process and a second multi-color misalignment correction control mode excluding the skew misalignment correction process to correct multi-color misalignment of the multiple color misalignment detection test pattern images. A memory stores the amount of skew misalignment calculated by the multi-color misalignment calculator when the process control unit initiates the second multi-color misalignment correction control mode.

11 Claims, 9 Drawing Sheets

APPARATUS AND METHOD FOR FORMING IMAGE

CROSS-REFERENCE TO RELATED APPLICATION

This patent application is based on and claims priority pursuant to 35 U.S.C. §119(a) to Japanese Patent Application No. 2014-120930, filed on Jun. 11, 2014 in the Japan Patent Office, the entire disclosure of which is hereby incorporated by reference herein.

BACKGROUND

1. Technical Field

Embodiments of this invention relate to an image forming apparatus, such as a printer, a copier, a facsimile machine, etc., that forms multiple color misalignment detection test pattern images to detect component color misalignment and aligns multiple component color toner images based on detection of these multiple color misalignment detection test patterns, and a method of forming an image by detecting component color misalignment and coinciding multiple component color toner images based on detection of these multiple color misalignment detection test patterns in the image forming apparatus.

2. Related Art

In a known belt type image forming apparatus, an endless intermediate transfer belt acting as an intermediate transfer member is wound around multiple rollers to endlessly move therearound. Four photoconductive members are brought in contact with a front surface of the intermediate transfer belt while forming four primary transfer nips therebetween, respectively, to form component color toner images of Y (yellow), M (magenta), C (cyan), and K (black). Subsequently, the Y, M, C, and K color toner images respectively formed on the surfaces of the Y, M, C, and K photoconductive members are transferred and superimposed sequentially on the intermediate transfer belt via the primary transfer nips for Y, M, C, and K colors, respectively. Then, the superimposed Y, M, C, and K color toner images are secondarily transferred onto a recording sheet at once as a full-color image.

Instead of using the above-described belt type intermediate transfer belt, another known image forming apparatus employs an endlessly moving sheet conveyor belt that holds and conveys a recording sheet on a surface of the endlessly moving sheet conveyor belt. Specifically, Y, M, C, and K toner images respectively formed on the surfaces of Y, M, C, and K color photoconductive members are directly transferred and superimposed on the recording sheet held on the endlessly moving sheet conveyor belt thereby ultimately becoming a full-color image thereon.

Since the multiple component color toner images, respectively formed on the photoconductive members, are sequentially transferred and superimposed on either the surface of the intermediate transfer member such as an intermediate transfer belt, etc., or that of the recording sheet held on the intermediate transfer member, each of the above-described image forming apparatuses is called a tandem-type image forming apparatus.

SUMMARY

Accordingly, one aspect of the present invention provides a novel image forming apparatus that includes multiple latent image bearers to bear latent images; multiple latent image writing units to write multiple latent images and multiple color misalignment detection test pattern images on the multiple latent image bearers; and multiple developing devices to render the multiple latent images and multiple color misalignment detection test pattern images borne on the multiple latent image bearers visible with toner of component colors. Also included in the novel image forming apparatus are multiple transfer units to transfer and superimpose visible images rendered visible by the multiple developing devices on the multiple latent image bearers onto either an intermediate transfer member or a recording medium; and multiple test pattern image detectors to detect the multiple color misalignment detection test pattern images transferred from the multiple latent image bearers onto either the intermediate transfer member or the recording medium and outputs position readings of the multiple color misalignment detection test pattern images. Further included in the novel image forming apparatus are a multi-color misalignment calculator to calculate an amount of multi-color misalignment of the multiple color misalignment detection test pattern images including skew misalignment thereof based on the position readings outputted from the multiple test pattern image detectors; and an image formation condition adjusting unit to change an image formation condition of the image forming apparatus in accordance with the amount of multi-color misalignment of the multiple color misalignment detection test pattern images calculated by the multi-color misalignment calculator. Yet further included in the novel image forming apparatus are a process control unit to initiate a first multi-color misalignment correction control mode and a second multi-color misalignment correction control mode to correct the multi-color misalignment of the multiple color misalignment detection test pattern images by executing a skew misalignment correction process during a system idling time period to correct the skew misalignment and a misalignment correction process other than the skew misalignment correction process during an image forming operation time period, respectively; and a memory to store the amount of skew misalignment calculated by the multi-color misalignment calculator when the process control unit initiates the second multi-color misalignment correction control mode while excluding the skew misalignment correction process. The process control unit initiates the first multi-color misalignment correction control mode to execute the skew misalignment correction process when the amount of skew misalignment stored in the memory reaches a prescribed threshold, and the multiple latent image writing units correct the multi-color misalignment in accordance with the image formation condition changed by the image formation condition adjusting unit in the first and second multi-color misalignment correction control modes.

Another aspect of the present invention provides a novel method of forming an image that comprises the steps of: starting a print job; writing multiple latent images on multiple latent image bearers with multiple latent image writing units; and developing the multiple latent images borne on the multiple latent image bearers into visible images with multiple developing devices. The novel method further comprises the steps of: transferring and superimposing the visible images with multiple transfer units from the multiple latent image bearers onto either an intermediate transfer member or a recording medium; timely forming multiple color misalignment detection test pattern images composed of component color images on the multiple latent image bearers; and transferring the multiple color misalignment detection test pattern images composed of component color images onto either the intermediate transfer member or the recording medium from the multiple latent image bearers. The novel method further comprises the steps of: optically detecting the multiple color misalignment detection test pattern images with multiple test pattern image detectors on either the intermediate transfer member or the recording medium; generating position readings of the multiple color misalignment detection test pattern images with the multiple test pattern image detectors; and calculating an amount of multi-color misalignment of each of the multiple color misalignment detection test pattern images borne on either the intermediate transfer member or the recording medium with multi-color misalignment calculators based on the position readings outputted from the multiple test pattern image detectors, the multi-color misalignment including registration and skew misalignments. The novel method further comprises the steps of: changing an image formation condition of the image forming apparatus per component color with an image formation condition adjusting unit in accordance with the amount of multi-color misalignment of each of the multiple color misalignment detection test pattern images calculated by the multi-color misalignment calculator; initiating a second multi-color misalignment correction control mode including a registration misalignment correction process and excluding a skew misalignment correction process during the print job to correct the registration misalignment of the multiple color misalignment detection test pattern images; and storing the amount of skew misalignment calculated by the multi-color misalignment calculator in a memory during the second multi-color misalignment correction control mode. The novel method further comprises the steps of: determining if the amount of skew misalignment stored in the memory exceeds a prescribed threshold; initiating a first multi-color misalignment correction control mode including the skew misalignment correction process to correct the skew misalignment of the multiple color misalignment detection test pattern images when determination of the step of determining if the amount of skew misalignment stored in the memory exceeds the prescribed first threshold is positive; and driving multiple latent image writing units in accordance with the image formation condition changed by the image formation condition adjusting unit during the first and second multi-color misalignment correction control modes.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
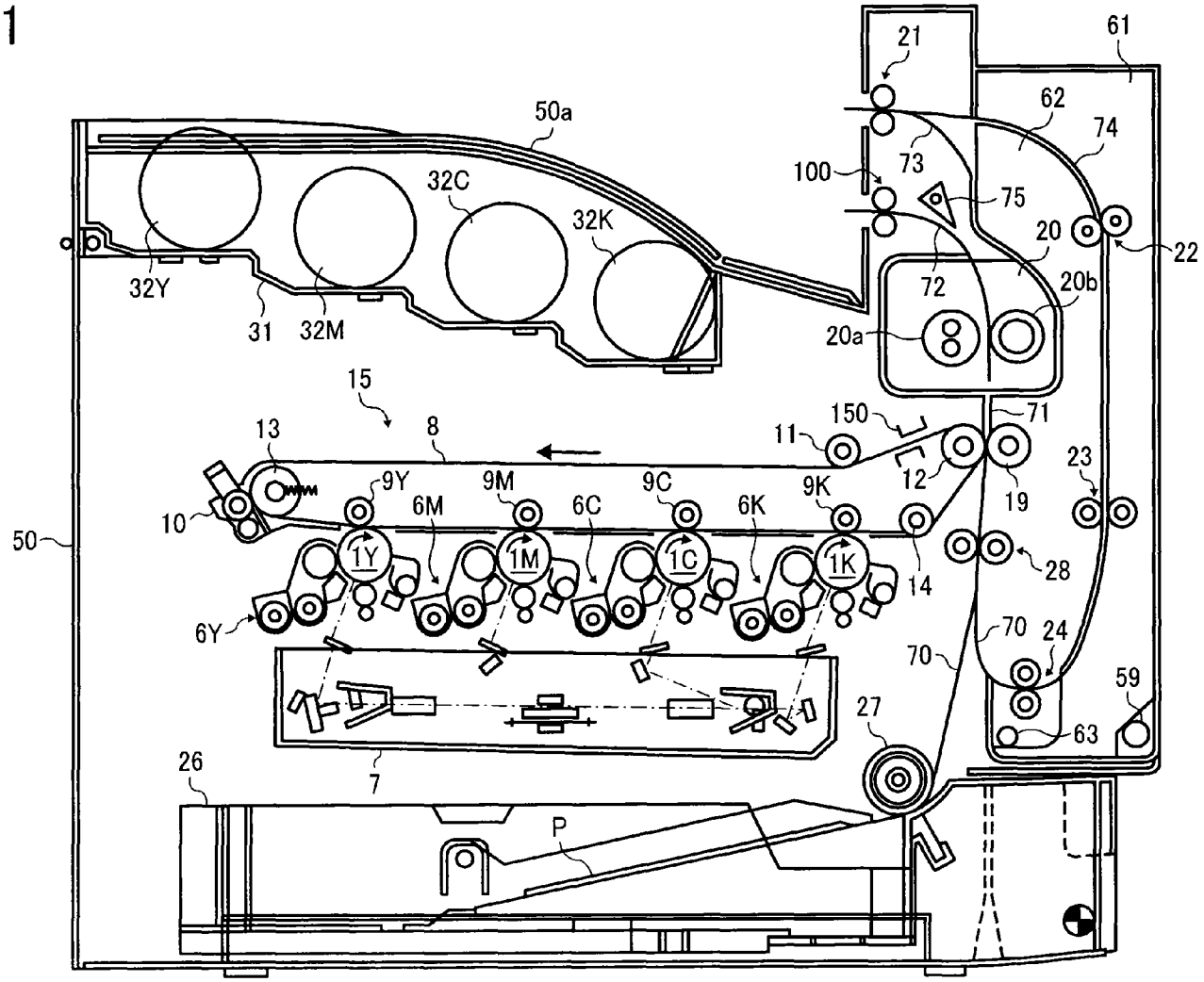
FIG. 1 is a diagram schematically illustrating a configuration of an exemplary image forming apparatus according to one embodiment of the present invention.

With the tandem-type image forming apparatus, productivity (i.e., the maximum number of printing sheets obtained per unit time) is greatly improved.

However, when the temperature of components such as lens, mirrors, etc., included in an optical system of the image forming apparatus for the purpose of optically writing a latent image on a photoconductive member changes, a path of an optical writing beam slightly deviates accordingly in a circumferential direction of the photoconductive member. As a result, a latent image formation position relatively deviates in a sub-scanning direction (i.e., a surface movement direction of the photosensitive member) from that of the other latent images of different component colors among the multiple photoconductive members, thereby causing so-called registration misalignment.

When misaligned toner images obtained via developing processes implemented thereafter are transferred as is, since each of the component color toner images is displaced from every other in the sub-scanning direction, multi-color misalignment accordingly occurs while degrading a color tone of a full-color image.

Further, when either a scanning line of the optical system inclines on a surface of the photoconductive member due to a change in temperature or the like or a posture of the photoconductive member itself is changed (i.e., tilts) for some reason, so-called skew misalignment also occurs thereon such that a posture of a toner image formed on the photoconductive member is changed and relatively inclines from that of the other toner image or images. The skew misalignment also causes the multi-color misalignment as well.

Hence, in the tandem-type image forming apparatus, to correct the multi-color misalignment occurring due to the above-described registration and skew misalignment or the like, multi-color misalignment correction control as herein below described in detail is needed.

That is, a test pattern image composed of multiple test pattern toner images of respective component colors is initially formed on an intermediate transfer belt to detect component color misalignment generated therebetween. Subsequently, a position of each of the component color test pattern toner images included in the test pattern image is detected by a sensor or sensors, and an amount of multi-color misalignment of each of the color test pattern toner images is calculated based on the detection result. Subsequently, in accordance with the amount of multi-color misalignment of each of the component color test pattern toner images calculated based on the detection result, either an optical path of the optical system or an image writing start position for applicable component color or component colors is adjusted by changing a pixel clock frequency or the like.

The multi-color misalignment may be corrected while the image forming apparatus idles. That is, a test pattern is formed at a detection position or positions on the intermediate transfer belt (e.g., one end, a center, and the other end of the intermediate transfer belt in its widthwise direction), skew misalignment, registration misalignment, and magnification misalignment (i.e., error) are detected and calculated. Subsequently, based on these calculation results, either the optical path of the optical writing system or the image writing start position of applicable component color or colors are corrected and adjusted.

However, in this case, since the test pattern is formed in a prescribed area on the intermediate transfer belt in which an image is written corresponding to a recording sheet, the multi-color misalignment correction control cannot be implemented during a print job (i.e., image formation) and needs to run during a system idling period when the print job is stopped (hereinafter simply referred to as a system idling period multi-color misalignment correction control).

By contrast, image forming apparatuses that execute multi-color misalignment correction control during a print job (hereinafter simply referred to as a print job-performing period multi-color misalignment correction control) are known. To correct the multi-color misalignment during the print job and reduce a system downtime, a test pattern is only formed on an intermediate transfer belt in an outside of a region in which an image is written and detected during continuous image formation on multiple recording sheets as a job. Hence, multi-color misalignment correction control is conducted during the print job based on a detection result of the test pattern.

In general, correction control of registration misalignment of a multi-color image can be achieved based on a digital technology. For example, an image writing position of an applicable component color is corrected. By contrast, however, the skew misalignment of the multi-color image requires mechanical adjustment, such as correction of a position of a mirror etc., in an optical path of an optical system in addition to digital adjustment of an applicable component color. Since the mechanical adjustment generally takes a relatively longer time, correction of the skew misalignment as multi-color misalignment correction control is not executed until the end of a print job. However, when either a large number of images needs to be continuously formed on multiple recording sheets or that of print jobs need to be continued and the mechanical adjustment is not executed until the end of the print job, the skew misalignment undesirably accumulates. To avoid such accumulation of the skew misalignment, an interval between multi-color misalignment correction control processes (i.e., system idling periods) is conventionally shortened.

Figure 2:
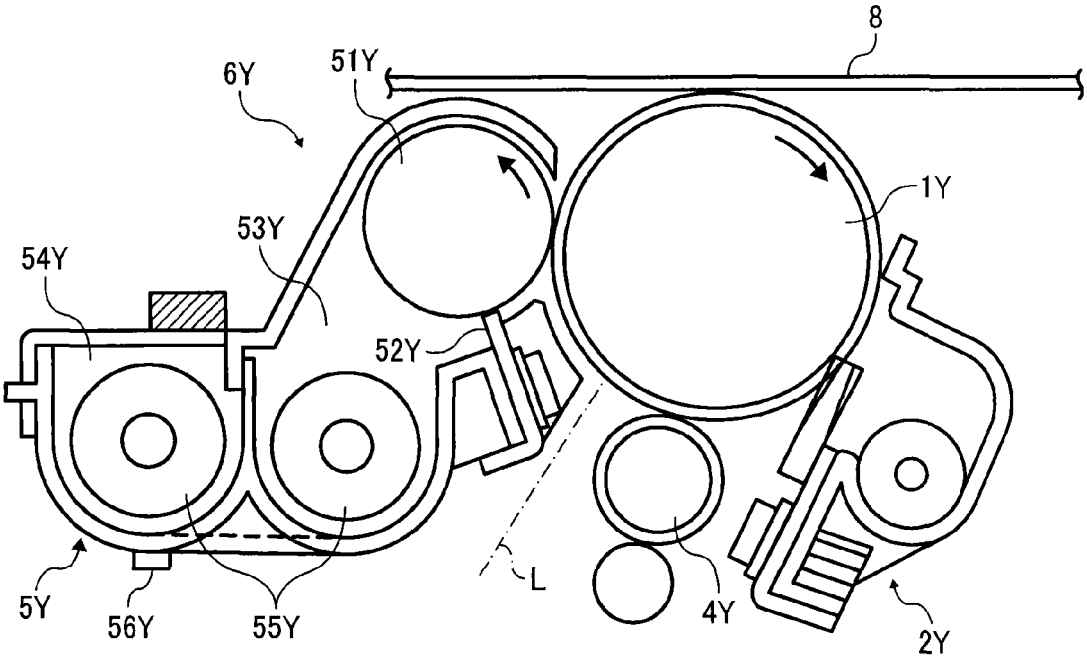
FIG. 2 is an expanded view schematically illustrating a configuration of an exemplary image formation unit for Y color provided in the image forming apparatus of FIG. 1 according to one embodiment of the present invention.

Referring now to the drawings, wherein like reference numerals designate identical or corresponding parts throughout the several views thereof, and in particular to FIG. 1, an image forming apparatus that employs electrophotography is schematically illustrated with a block diagram according to one embodiment of the present invention. Specifically, as shown in the drawing, the image forming apparatus is provided with four image formation units 6Y, 6M, 6C, and 6K to respectively produce toner images of yellow, magenta, cyan, and black colors (hereinafter simply referred to as Y, M, C, and K). Although these four image formation units 6Y, 6M, 6C, and 6K employ component color toner particles as coloring material different from each other, these units are otherwise similarly configured and are each replaced when reaching its life. Now, an image formation unit 6Y for forming a Y color toner image is herein below typically described as one example. As shown in FIG. 2, the image formation unit 6Y as an image forming device includes a drum-shaped photoconductive member 1Y as a latent image bearer, a drum cleaning unit 2Y, an electric charge removing device (not shown), an electric charger 4Y, and a developing device 5Y or the like. The image formation unit 6Y is detachably attached to a main body of the image forming apparatus as a unit.

The electric charger 4Y uniformly charges a surface of the drum-shaped photoconductive member 1Y driven and rotated clockwise by a driving unit not shown in the drawing. The surface of the photoconductive member 1Y bearing the uniform charge thereon is then subjected to scanning exposure of a laser light beam L thereby bearing an electrostatic latent image thereon. This Y color electrostatic latent image is then developed and rendered to be a toner image by a developing device 5Y that utilizes Y color developer containing Y color toner and magnetic carrier. Subsequently, the toner image is primarily transferred onto an intermediate transfer belt 8 in a primary transfer process as described later in detail. A drum cleaning unit 2Y then eliminates transfer residual toner adhering to the surface of the photoconductive member 1Y that has completed the primary transfer process. The above-described electric charge removing device removes residual electric charge remaining on the surface of the photoconductive member 1Y having completed a cleaning process. Hence, the surface of the photoconductive member 1Y is initialized in the charge removing process and is prepared for the next image formation. In the other remaining component color imaging forming units 6M, 6C and 6K, multiple component color toner images M, C, and K are also formed at the same time on the respective photoconductive members 1M, 1C and 1K in a similar way and are superimposed on the intermediate transfer belt 8 during the primary transfer processes.

The developing device 5Y as a developing device includes a developing roller 51Y partially exposed from an opening of a housing thereof. The developing device 5Y includes two developer conveying screws 55Y disposed in parallel to each other, a doctor blade 52Y, and a toner density sensor 56Y or the like as well.

In the housing of the developing device 5Y, Y color developer including magnetic carrier and Y color toner, not shown, is accommodated. The Y color developer is agitated and conveyed by the two developer conveying screws 55Y while being triboelectrically charged and is ultimately borne on a surface of the developing roller 51Y. Subsequently, when a layer thickness of the Y color developer has been regulated (i.e., flattened) by the doctor blade 52Y, the Y color developer is conveyed to a development region opposite the photoconductive member 1Y for Y color. Here, the Y color toner adheres to the electrostatic latent image borne on the photoconductive member 1Y. With this adhesion, a Y color toner image is ultimately formed on the photoconductive member 1Y. In the developing device 5Y, the Y color developer having consumed the Y color toner therein in the above-described developing process is returned to the housing as the developing roller 51Y rotates.

Here, a partition wall is provided in the housing between these two developer conveying screws 55Y. With the partition wall, a first developer supply unit 53 that accommodates the developing roller 51Y and the developer conveying screw 55Y located on the right side in the drawing or the like is separated in the housing from a second developer supply unit 54Y that accommodates the developer conveying screw 55Y located on the left side in the drawing. The developer conveying screw 55Y located on the right side in the drawing is driven and rotated by a driving unit, not shown, thereby conveying the Y color developer stored in the first developer supply unit 53Y from a front side to a back side in the drawing and ultimately into the developing roller 51Y. Here, the Y color developer conveyed by the developer conveying screw 55Y located on the right side in the drawing near the end of the first developer supply unit 53Y enters the second developer supply unit 54Y through an opening, not shown, provided in the above-described partition wall. In the second developer supply unit 54Y, the developer conveying screw 55Y located on the left side in the drawing is driven and rotated by a driving unit, not shown, and conveys the Y color developer transferred from the first developer supply unit 53Y in an opposite direction to that in which the developer conveying screw 55Y on the right side in the drawing conveys the Y color developer. Thus, the Y color developer is conveyed near the end of the second developer supply unit 54Y by the developer conveying screw 55Y located in the left side in the drawing and returns to the first developer supply unit 53Y via another opening (not shown) provided in the above-described partition wall.

A toner density sensor 56Y composed of a magnetic permeability sensor is provided on a bottom wall of the above-described second developer supply unit 54Y and outputs a voltage in accordance with a magnetic permeability of the Y developer passing through thereabove. Since the magnetic permeability of the two-component developer containing toner and magnetic carrier indicates a good correlation between toner density and itself, a toner density sensor 56Y accordingly outputs a voltage in accordance with toner density of the Y color toner. The output voltage of the toner density sensor 56Y is transmitted to a control unit, not shown. The control unit, not shown, includes a RAM (Random Access Memory) that stores a Vtref for Y color as a target value for the output voltage outputted from the toner density sensor 56Y. In the RAM, data of Vtref, Vtref, and Vtref for M, C, and K colors are also stored as target values for the output voltages outputted from the respective toner density sensors, not shown, mounted on the other developing devices. The Vtref for Y color is used to control operation of the later described toner conveying device for Y color, not shown. Specifically, to bring the output voltage outputted from the toner density sensor 56Y close to the Vtref for Y color, the above-described control unit controls operation of the toner conveying device for Y color to supply the Y color toner into the second developer supply unit 54Y. With the above-described supply, density of the Y color toner included in the Y color developer stored in the developing device 5Y is maintained within a prescribed range. In each of the developing devices included in the other process units, supplying of toner is similarly controlled by using each of M, C, and K color toner conveying devices as well.

As described earlier with reference to FIG. 1, below the image formation units 6Y, 6M, 6C, and 6K, the optical writing unit 7 acting as a latent image formation unit is disposed. The optical writing unit 7 provides optical scanning to each of the photoconductive members 1Y to 1K respectively included in the image formation units 6Y, 6M, 6C, and 6K by using the laser light beam L emitted based on image information. With this optical scanning, multiple electrostatic latent images of Y, M, C, and K colors are formed on the photoconductive members 1Y, 1M, 1C, and 1K, respectively. Here, in the optical writing unit 7, the laser light beam L emitted from a light source is diffused by a polygon mirror driven and rotated by a motor and is irradiated to scan the photoconductive member while passing through multiple optical lenses and mirrors.

Below the optical writing unit 7 in the drawing, a sheet accommodating unit including a sheet accommodating cassette 26 and a sheet feeding roller 27 built therein or the like is disposed. The sheet accommodating cassette 26 accommodates a stack of multiple recording sheets P as sheet like recording media. A sheet feeding roller 27 is provided while contacting the topmost recording sheet P. Hence, when the sheet feeding roller 27 is rotated by a driving unit, not shown in the drawing, counterclockwise, the topmost recording sheet P is launched toward a sheet supplying path 70.

Near the end of the sheet supplying path 70, a pair of registration rollers 28 is disposed. Here, although the pair of registration rollers 28 is rotated to pinch the recording sheet P therebetween, both registration rollers immediately stop rotating when having pinched the recording sheet P therebetween. Subsequently, both registration rollers resume rotation at a prescribed appropriate time to further feed the recording sheet P downstream toward the later described secondary transfer nip.

As shown in the drawing, above the image formation units 6Y, 6M, 6C, and 6K, a transfer unit 15 is disposed, in which an intermediate transfer belt 8 acting as an intermediate transfer member is suspended and is endlessly moved and rotated. The transfer unit 15 includes a secondary transfer bias roller 19 and a cleaning unit 10 beside the intermediate transfer belt 8. The transfer unit 15 also includes four primary transfer bias rollers 9Y, 9M, 9C, and 9K, a driving roller 12, a cleaning backup roller 13, and a secondary transfer nip inlet roller 14 or the like. Hence, the intermediate transfer belt 8 is endlessly moved counterclockwise in the drawing by the driving roller 12 with its being wound around each of these seven rollers.

Thus, these primary transfer bias rollers 9Y, 9M, 9C, and 9K and the photoconductive members 1Y, 1M, 1C, and 1K sandwich the endlessly moving intermediate transfer belt 8 and form the primary transfer nips there between, respectively. To each of these primary transfer bias rollers 9Y, 9M, 9C, and 9K, a primary transfer bias having a reverse polarity (e.g., positive polarity) to that of toner is applied. The above-described rollers other than the primary transfer bias rollers 9Y, 9M, 9C, and 9K are all electrically grounded.

As the intermediate transfer belt 8 endlessly moves while sequentially passing through the primary transfer nips for Y, M, C, and K colors, the toner images Y, M, C, and K borne on the respective photoconductive members 1Y, 1M, 1C, and 1K are primarily transferred sequentially and superimposed thereon. With this, a four-component color superimposed toner image (hereinafter simply referred to as a four-component color toner image) is formed on the intermediate transfer belt 8.

The driving roller 12 and a secondary transfer bias roller 19 acting as a contact/separation mechanism sandwich the intermediate transfer belt 8 and form a secondary transfer nip therebetween. Hence, the four-component color toner image formed and borne on the intermediate transfer belt 8 is transferred onto a recording sheet P in the secondary transfer nip. Accordingly, in association with white color of the recording sheet P, the four-component color toner image is rendered to be a four-component color toner image. The driving roller 12 that drives the intermediate transfer member and the secondary transfer bias roller 19 are made of rubber in consideration of transferability of a full color toner image onto the recording sheet P as commonly made in the past.

Further, a contact/separation mechanism is provided to enable the secondary transfer bias roller 19 to either engage or disengage with the driving roller 12 that drives the intermediate transfer member. The contact/separation mechanism desirably employs a spring or the like. To ensure transfer performance of a toner image required when it is transferred from the intermediate transfer belt 8 onto the recording sheet P during the secondary transfer process, the secondary transfer bias roller 19 is brought in contact with the driving roller 12. By contrast, when multi-color misalignment correction control is implemented during a system idling period, to prevent both contamination of the secondary transfer bias roller 19 due to adhesion of toner and blur of positional deviation (i.e., misalignment) detection pattern images 42 or the like, the secondary transfer bias roller 19 is separated from the driving roller 12. Here, the system idling period represents a time when a print job is not conducted in the image forming apparatus. Furthermore, when the multi-color misalignment correction control is implemented during the print job, since a toner image is actually transferred onto the recording sheet P at the same time, the secondary transfer bias roller 19 is also brought in contact with the driving roller 12.

Here, to the intermediate transfer belt 8 passing through the secondary transfer nip, transfer residual toner not transferred onto the recording sheet P adheres. However, the transfer residual toner is cleaned by the cleaning unit 10 after that. The recording sheet P with the four-component color toner image transferred at once in the secondary transfer nip is sent to the fixing device 20 via a post-transfer conveyance path 71.

The fixing device 20 includes a fixing roller 20*a* that accommodates a heat source such as a halogen lamp, etc., and a rotatable pressing roller 20*b* that presses against the fixing roller 20*a* with a given pressure and forms a fixing nip therebetween. Hence, the recording sheet P fed into the fixing device 20 is caught by the fixing nip with its surface bearing an unfixed toner image tightly brought in contacted with the fixing roller 20*a*. Subsequently, with impacts of heat and pressure, toner in the toner image is softened, so that the full-color image is fixed onto the recording sheet P.

After leaving the fixing device 20 bearing the full-color image fixed thereon in the fixing device 20, the recording sheet P approaches a fork formed between a sheet ejection path 72 and a sheet pre-inversion conveyance path 73. At the fork, a first switching nail 75 swings to switch a course of the recording sheet P to advance. Specifically, the first switching nail 75 provides a course directed toward the sheet ejection path 72 to the recording sheet P when a nail tip thereof is moved closer to the pre-inversion conveyance path 73. By contrast, the first switching nail 75 provides another course directed toward the pre-inversion conveyance path 73 to the recording sheet P when the nail tip thereof is distanced from the pre-inversion conveyance path 73.

When the course heading to the sheet ejection path 72 is selected by the first switching nail 75, the recording sheet P is ejected outside the image forming apparatus from the sheet ejection path 72 after passing through a pair of sheet ejection rollers 100 and is stacked on a stack 50*a* established on the top of a body of the image forming apparatus. By contrast, when the course heading to the pre-inversion conveyance path 73 is selected by the first switching nail 75, the recording sheet P enters a nip formed between a pair of inversion rollers 21 after passing through the pre-inversion conveyance path 73. Although it pinches and conveys the recording sheet P toward the stack section 50*a*, the pair of inversion rollers 21 reversely rotates just before the end of the recording sheet P enters the nip formed therebetween. With this reversal, the recording sheet P is reversely conveyed in an opposite direction to a previously advancing direction, so that the end of the recording sheet P accordingly enters the inversion conveyance path 74.

The inversion conveyance path 74 extends downwardly while curving from the upper side in a vertical direction. The inversion conveyance path 74 includes a pair of first inversion conveyance rollers 22, a pair of second inversion conveyance rollers 23, and a pair of third inversion conveyance rollers 24. Hence, the recording sheet P is turned upside down when conveyed through nips formed between each pair of rollers sequentially. The recording sheet P turned upside down is returned to the above-described sheet supplying path 70 and then reaches the secondary transfer nip again. The recording sheet P enters the secondary transfer nip while bringing a non-image bearing surface thereof in tightly contact with the intermediate transfer belt 8, so that a four-component color toner image borne on the intermediate transfer belt 8 is secondary transferred at once on to the non-image bearing surface thereof. After that, the recording sheet P is stacked on the stack section 50*a* located outside the image forming apparatus via a post conveyance paths 71, the fixing device 20, the sheet ejection path 72, and the pair of sheet ejection rollers 100. With this inversion conveyance of the recording sheet P, a full-color image is ultimately formed on both sides of the recording sheet P.

Further, between the transfer unit 15 and the stack section 50*a* located thereabove, there is disposed a bottle supporting unit 31. The bottle supporting unit 31 accommodates multiple toner bottles 32Y, 32M, 32C, and 32K acting as toner containers to store Y, M, C, and K toner particles, respectively. These Y, M, C, and K toner particles stored in the toner bottles 32Y, 32M, 32C, and 32K are supplied to the developing devices of the image formation units 6Y, 6M, 6C, and 6K by respective toner conveying devices, not shown, from time to time. Each of these toner bottles 32Y, 32M, 32C, and 32K is detachably attached to the body of the image forming apparatus independently from the image formation units 6Y, 6M, 6C, and 6K.

Figure 3:
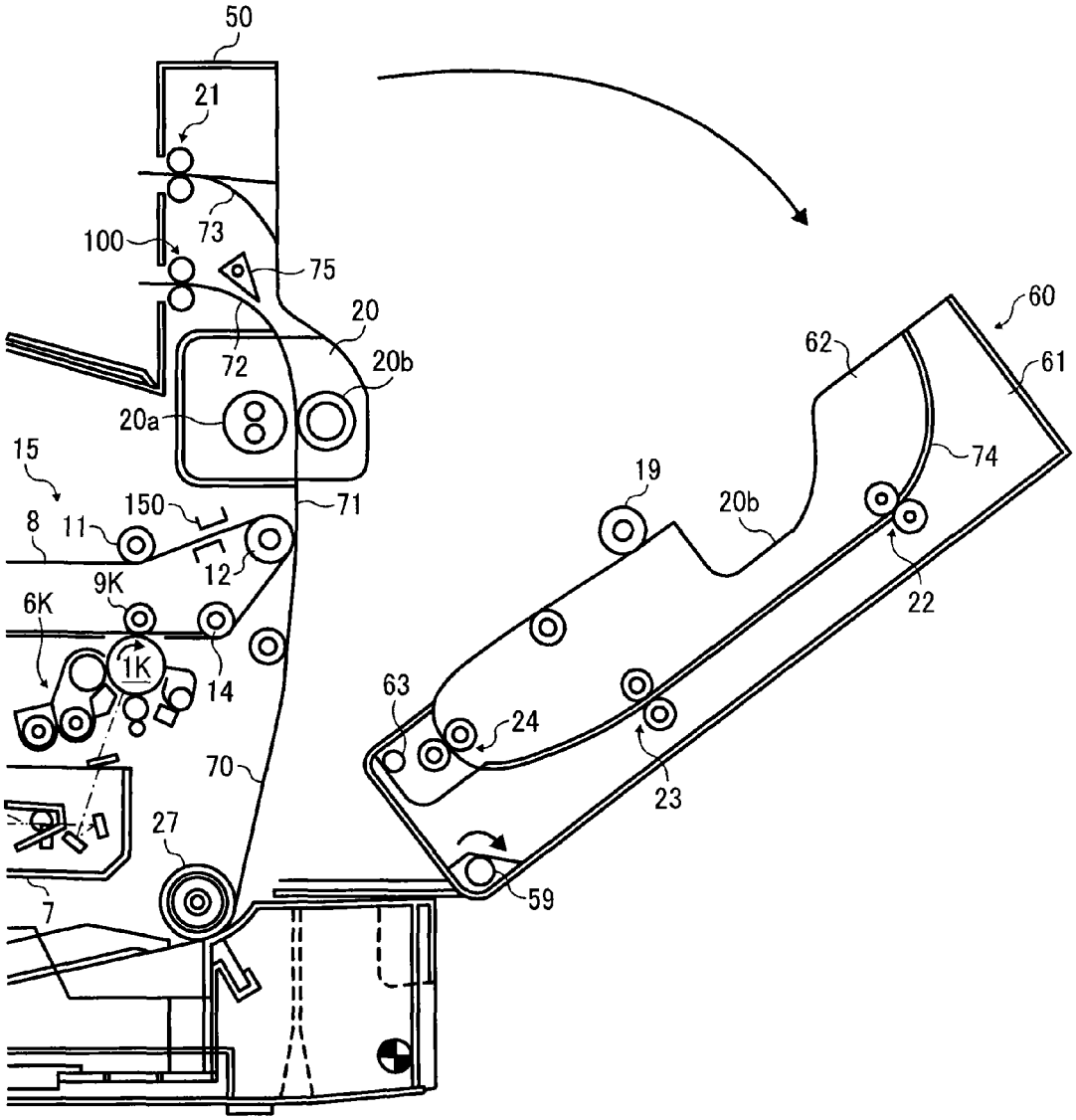
FIG. 3 is a diagram partially illustrating an exemplary operation of an opening and closing cover provided in the image forming apparatus of FIG. 1 according to one embodiment of the present invention.

The inversion conveyance path 74 is established in an opening and closing cover. The opening and closing cover includes an external cover 61 and a swinging support member 62. Specifically, the external cover 61 of the opening and closing cover is supported to swing around a first rotary shaft 59 attached to a housing 50 of the main body of the image forming apparatus. With this swinging, the external cover 61 opens and closes an opening, not shown, formed in the housing 50. Further, as shown in FIG. 3, the swinging support member 62 is held on the external cover 61 to be exposed while swinging around a second rotary shaft 63 attached to the external cover 61 when the external cover 61 is opened. With this swinging, since the swinging support member 62 swings around the second rotary shaft 63 of the external cover 61 when it is opened from the housing 50 and the external cover 61 accordingly separates from the swinging support member 62, the inversion conveyance path 74 is exposed. Since the inversion conveyance path 74 is exposed, a sheet jamming in the inversion conveyance path 74 can be easily removed.

Figure 4:
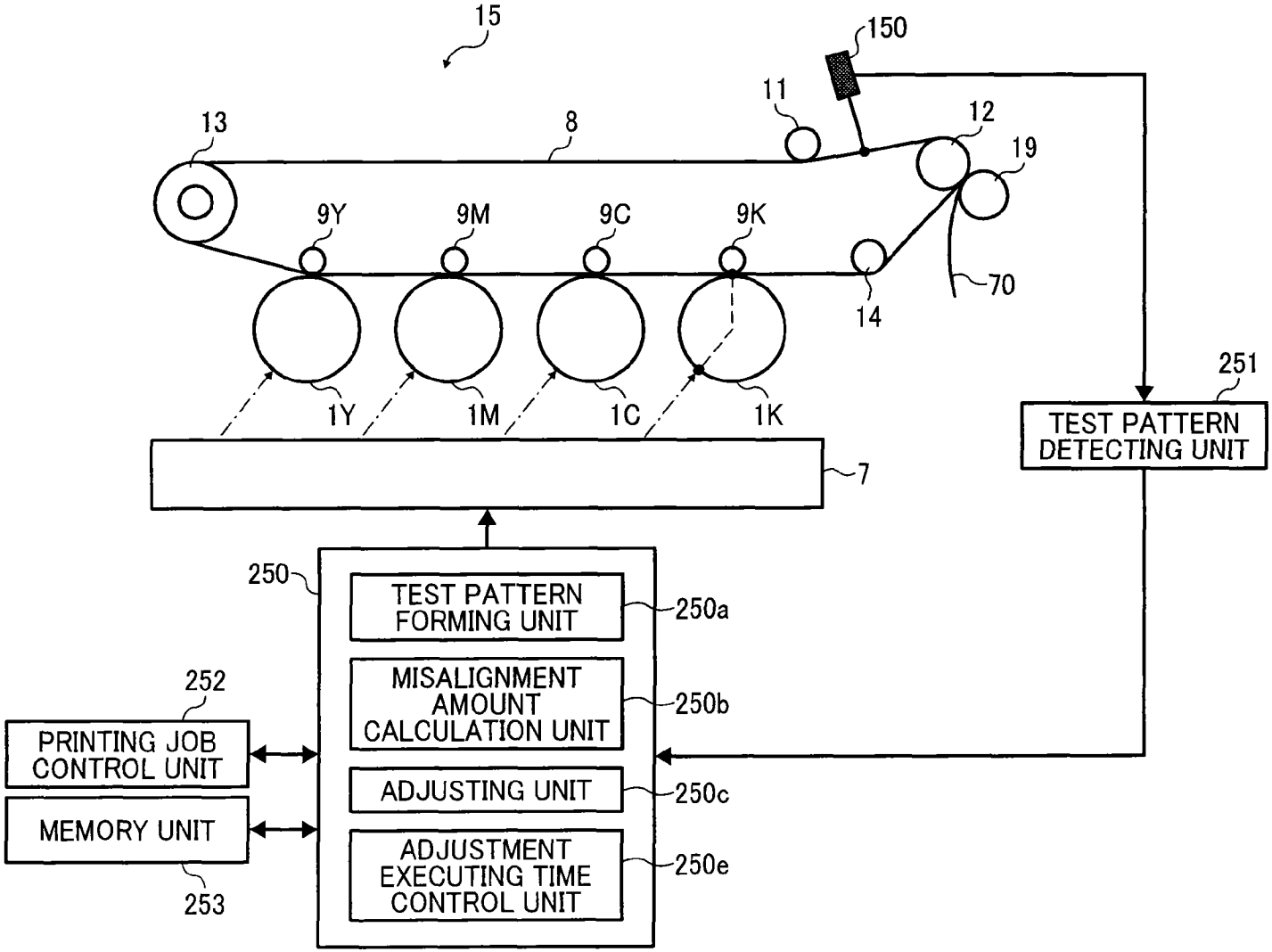
FIG. 4 is a block diagram illustrating exemplary control system that executes an image adjustment control process in the image forming apparatus of FIG. 1 by using a test pattern according to one embodiment of the present invention.

FIG. 4 is a block diagram schematically illustrating an exemplary function to adjust an image using a test pattern. As shown, a control unit 250 acting as a control device includes a test pattern forming unit 250*a*, a misalignment amount calculation unit 250*b*, an adjustment unit 250*c*, and an adjustment executing time control unit 250*e* or the like.

The test pattern forming unit 250*a* forms a test pattern by controlling the optical writing unit 7 at a detection position on the intermediate transfer belt either within an region in which an image is written corresponding to a recording sheet or outside the region thereof. The misalignment amount calculation unit 250*b* calculates amounts of various misalignments of the test pattern based on results of detection of the test patterns transmitted from a test pattern detecting unit 251.

The adjustment unit 250*c* conducts an image adjustment process based on an amount of misalignment calculated by the misalignment amount calculation unit 250*b*. Specifically, in the image adjustment process, an optical path extending in the optical system is corrected for each component color and/or a pixel clock frequency is changed to correct an image writing start position for each component color or the like. Since it is digitally corrected based on the calculated amount of misalignment, the correction of the image writing start position for each component color can be relatively quickly completed. By contrast, the correction of the optical path extending in the optical system for each component color relatively takes a long time, because it is conducted by mechanically moving the optical system including a light source and an f-θlens as well as a mirror disposed in the optical path to align positions of respective optical paths of respective component colors with each other based on the amount of misalignment.

Further, the adjustment unit 250*c* also selectively sets one of a system idling period multi-color misalignment correction control mode and a print job performing period multi-color misalignment correction control mode as well. In the system idling period multi-color misalignment correction control mode, an image adjustment process as multi-color misalignment correction control is conducted by forming a test pattern at the detection position on the intermediate transfer belt located both within the region corresponding to the recording sheet, in which an image is formed, and outside the region thereof as well. By contrast, in the print job performing period multi-color misalignment correction control mode, an image adjustment process as multi-color misalignment correction control is conducted by forming a test pattern at the detection position on the intermediate transfer belt located outside the region, in which an image is formed corresponding to the recording sheet. Furthermore, the adjustment unit 250*c* sets a mode and controls formation of a test pattern corresponding to the mode and aligns an applicable image or images based on an amount of misalignment as well.

Hence, the control unit 250 corrects a condition of image formation in accordance with the adjusted amount of misalignment, and conducts an image formation process by controlling the writing unit 7 and drive sources for driving the photoconductive members 1Y, 1M, 1C, and 1K in accordance with the image formation condition corrected in this way. Specifically, in the print job performing period multi-color misalignment correction control mode, in which an image adjustment process is conducted by forming a test pattern at a detection position on the intermediate transfer belt located outside the region in which an image is written corresponding to a recording sheet, a skew misalignment amount is stored in a memory unit 253 acting as data storage.

The adjustment executing time control unit 250*e* analyzes various factors related to a time to perform multi-color misalignment correction control, such as the number of fed job sheets, an amount of skew misalignment stored in the memory unit 253, a temperature of the image forming apparatus, an elapsed time, etc., and controls an execution flag. The print job control unit 252 outputs a print job start instruction signal to the control unit 250 to start both image formation of each page and a test pattern image as well. The print job control unit 252 also transmits information of the number of print job remaining sheets and that of remaining print jobs to the control unit 250.

Figure 5:
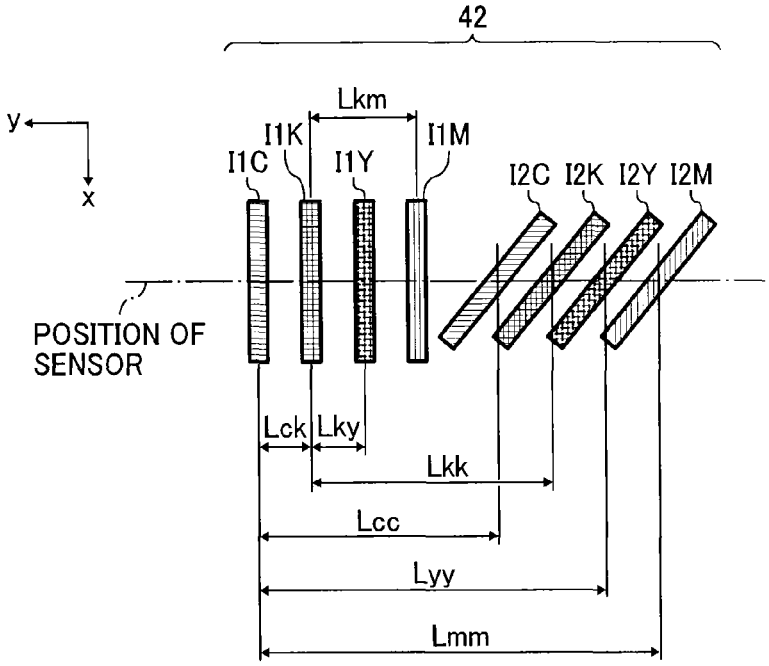
FIG. 5 is an expanded view schematically illustrating an exemplary test pattern image constituting the test pattern of FIG. 4 according to one embodiment of the present invention.

Hence, a positional deviation (i.e., misalignment) detection pattern image 42 shown in FIG. 5 is formed at the detection position on the intermediate transfer belt 8 (see FIG. 1) in its widthwise direction. The positional deviation (i.e., misalignment) detection pattern image 42 includes multiple first position detection images I1C, I1K, I1Y, and I1M respectively arranged at a predetermined length of interval in a sub-scanning direction. The positional deviation (i.e., misalignment) detection pattern image 42 also includes multiple second position detection images I2C, I2K, I2Y, and I2M arranged subsequent to the first position detection images I1C, I1K, I1Y, and I1M at a predetermined length of interval again. Here, in the drawing, a direction shown by arrow X indicates a main scanning direction (i.e., an axial direction of the photoconductive member). By contrast, a direction shown by arrow Y indicates the sub-scanning direction (i.e., a surface moving direction of the photoconductive member). As shown, these first position detection images I1C, I1K, I1Y, and I1M are formed while extending in the main scanning direction X. By contrast, these second position detection images I2C, I2K, I2Y, and I2M are formed while inclining from the direction X by about 45 [°] (i.e., an angle of 45 degrees).

Figure 6:
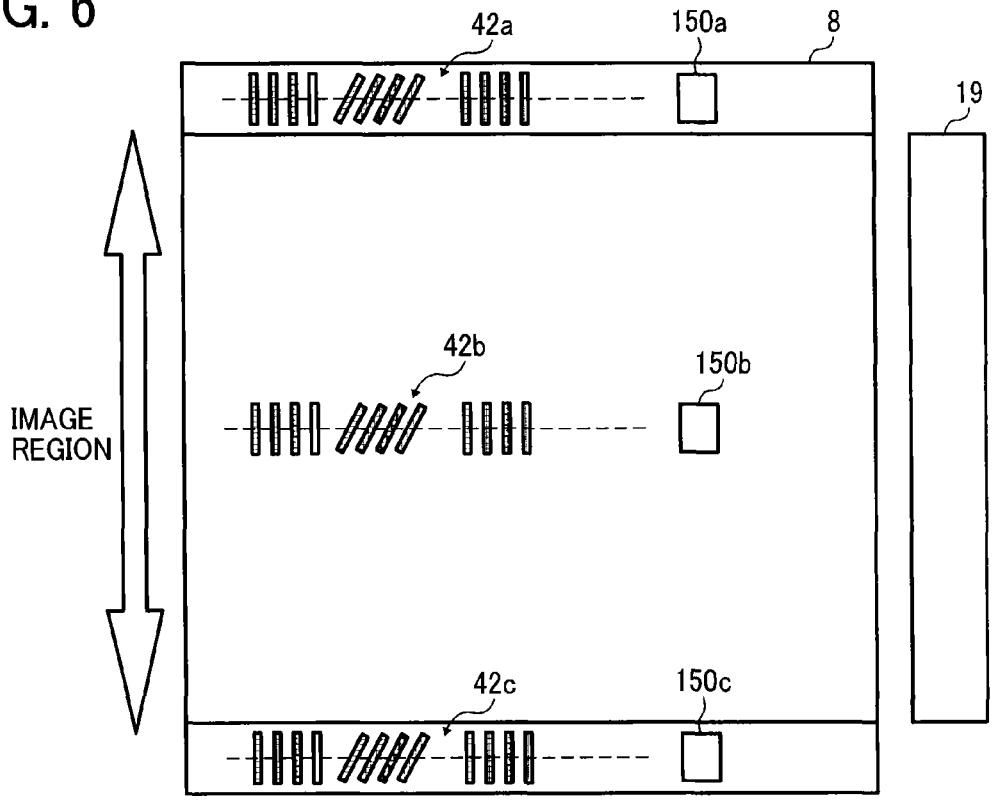
FIG. 6 is a diagram schematically illustrating an exemplary position at which a pattern image for detecting positional deviation (i.e., misalignment) is formed during a multi-color misalignment correction control mode running in an system idling period of the image forming apparatus of FIG. 1 according to one embodiment of the present invention.
Figure 7:
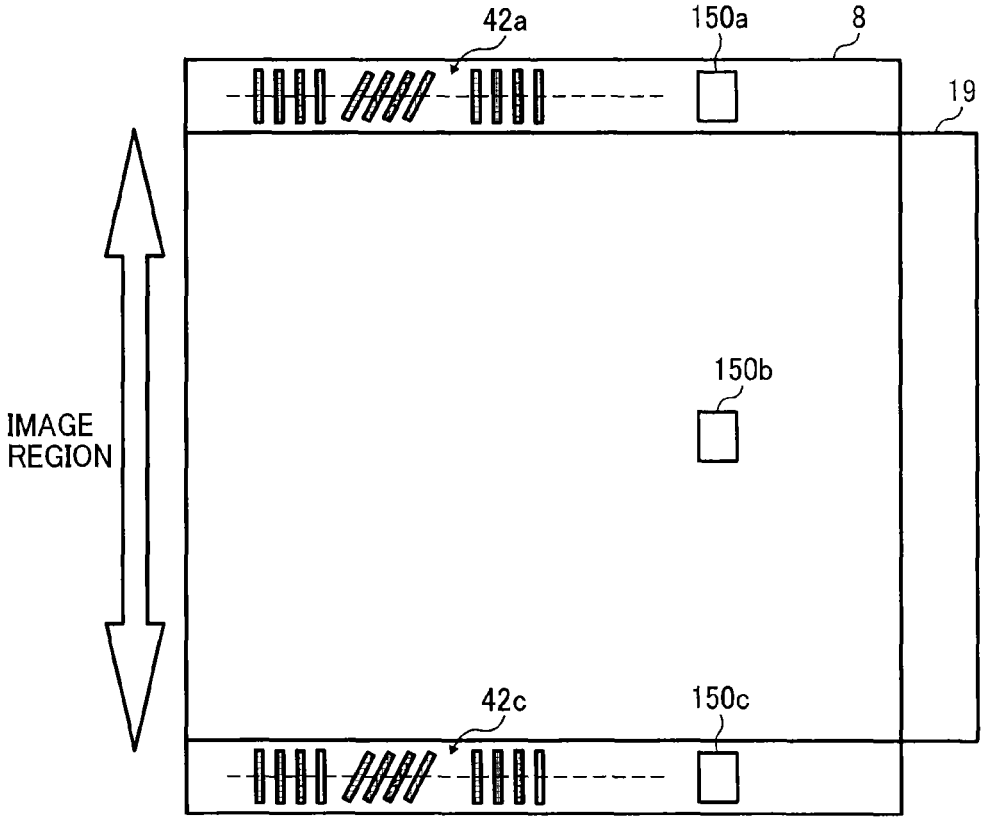
FIG. 7 is a diagram schematically illustrating an exemplary position at which a pattern image for detecting positional deviation (i.e., misalignment) is formed during a multi-color misalignment correction control mode during a print job of the image forming apparatus of FIG. 1 according to one embodiment of the present invention.

FIG. 6 illustrates an exemplary formation position at which the positional deviation (i.e., misalignment) detection pattern image is formed when multi-color misalignment correction control is conducted in a system idling period. As shown there, three sets of positional deviation (i.e., misalignment) detection pattern images (42*a*, 42*b*, and 42*c*) having the same structure as the positional deviation (i.e., misalignment) detection pattern image 42 shown in FIG. 5 are formed at each of one end, a center, and the other end of the intermediate transfer belt 8 in its widthwise direction (i.e., in the main scanning direction), respectively. FIG. 7 also illustrates another exemplary formation position at which the positional deviation (i.e., misalignment) detection pattern image 42 is formed when multi-color misalignment correction control is conducted during the print job. As shown there, two sets of positional deviation (i.e., misalignment) detection test pattern images 42*a* and 42*c* having the same structure as the positional deviation (i.e., misalignment) detection pattern image 42 shown in FIG. 5 are formed at side ends other than a center of the intermediate transfer belt 8 in its widthwise direction, respectively. Specifically, in the multi-color misalignment correction control conducted during the print job, the positional deviation (i.e., misalignment) detection pattern image 42*b* possibly formed at the widthwise center of the intermediate transfer belt 8 is not formed as different from that conducted during the system idling period. That is, in the multi-color misalignment correction control conducted during the print job, since the positional deviation (i.e., misalignment) detection pattern image 42 is formed in parallel with an image formation process, the positional deviation (i.e., misalignment) detection pattern image 42 can be formed on the intermediate transfer belt only at side ends thereof outside an region to write an image therein corresponding to a recording sheet.

Of the whole front surface region of the intermediate transfer belt 8 in its circumferential direction, an optical sensor unit 150 is opposed, via a prescribed gap, to a prescribed front surface region (i.e., an outer surface of a loop) located downstream of a winding position winding the driving roller 12 and up stream of a pressure position pressed by a pressing roller 11. Specifically, as shown in FIGS. 6 and 7, the optical sensor unit 150 includes a first optical sensor 150*a* opposed to the one end of the intermediate transfer belt 8, a second optical sensor 150*b* opposed to the center thereof, and a third optical sensor 150*c* opposed to the other end thereof.

Figure 8:
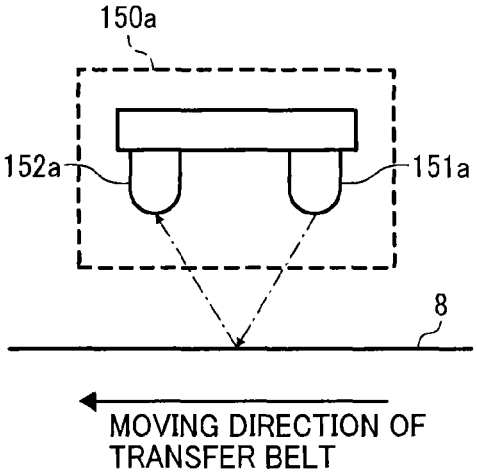
FIG. 8 is an enlarged view schematically illustrating an exemplary first optical sensor provided in the image forming apparatus of FIG. 1 according to one embodiment of the present invention.

FIG. 8 is an enlarged view typically illustrating an exemplary configuration of the first optical sensor 150*a*. The first optical sensor 150*a* includes a light emitting part 151*a* that emits light toward a front surface of the intermediate transfer belt 8 and a light receive part 152*a* that receives light reflected by the front surface of the intermediate transfer belt 8 and outputs a signal in accordance with intensity of the reflected light. Out of the entire front side region of the intermediate transfer belt 8, a prescribed front side region in which the positional deviation (i.e., misalignment) detection pattern image is not formed, specifically, toner does not adhere thereto, provides relatively intensive reflective light. By contrast, out of the entire front side region of the intermediate transfer belt 8, a prescribed front side region in which the positional deviation (i.e., misalignment) detection pattern image is formed, specifically, toner adheres thereto, provides a reduced amount of reflective light. Hence, due to the reduction of the amount of reflected light in this way, the positional deviation (i.e., misalignment) detection pattern image can be detected. Further, beside detecting the positional deviation (i.e., misalignment) detection pattern image like this, the first optical sensor 150*a* may detect multiple test images included in the later described line velocity changing pattern as well.

Although the first optical sensor 150*a* is describing heretofore, the second and third optical sensors 150*b* and 150*c* have the similar configurations to that of the first optical sensor 150*a*. Multiple signals transmitted from the respective light receive parts of the optical sensors 150*a* to 150*c* are transmitted to a test pattern detecting unit 251. The test pattern detecting unit 251 includes an A/D conversion circuit that converts a digital signal transmitted from the receiver into an analog signal. The test pattern detecting unit 251 detects the positional deviation (i.e., misalignment) detection pattern image and the test image when a digital value obtained after the A/D conversion falls below a predetermined threshold. Subsequently, the test pattern detecting unit 251 immediately outputs a detection signal to a misalignment amount calculation unit 250*b*.

Here, as the positional deviation (i.e., misalignment) generated between respective component color images, skew misalignment occurring due to inclination of posture of each of Y, M, and C toner images from that of a K toner color image acting as a reference color is exemplified. The positional deviation (i.e., misalignment) generated between respective component color images also includes a registration misalignment of the sub-scanning direction, in which all of image forming positions of Y, M, and C toner images are shifted from that of the K toner image in the sub-scanning direction. The positional deviation (i.e., misalignment) generated between respective component color images further includes misalignment occurring due to the whole magnification error in the main scanning direction and registration misalignment in the same direction as well. Here, the registration misalignment in the sub-scanning direction is misalignment of an image forming position of the entire toner image from a normal position in the sub-scanning direction.

Now, a method of calculating amounts of various misalignments when a test pattern is detected is specifically described herein below with reference to FIG. 5. Each of the optical sensors 150*a*, 150*b* and 150*c* placed at the above-described sensor positions in the drawing detects a mark line of the test pattern at a predetermined sampling time interval. Based on the detection result, the misalignment amount calculation unit 250*b* (see FIG. 4) calculates lengths of intervals between respective lateral component color patterns and those between the lateral line patterns and corresponding diagonal line patterns, respectively.

Then, various misalignment amounts are calculated based on the lengths of respective intervals calculated in this way.

That is, when an amount of registration misalignment in the sub-scanning direction (i.e., a multi-color misalignment amount in the sub-scanning direction) is calculated, lengths of intervals Lck, Lky, and Lkm between the pattern of the reference color K and those of target component colors of Y, M, and C are each calculated initially based on detection data of the lateral line patterns. Calculation results are then compared with lengths of default intervals Lck0, Lky0, and Lkm0 previously stored as defaults (i.e., initial settings), respectively. Subsequently, respective differences between the detected lengths of intervals and default lengths of intervals (e.g., Lck-Lck0, Lky-Lky0, and Lkm-Lkm0) are regarded as registration misalignment amounts generated in the respective Y, M, and C colors from the reference component color K in the sub-scanning direction.

When a registration misalignment amount in the main scanning direction (i.e., a multi-color misalignment amount in the main scanning direction) is calculated, lengths of intervals between the K to C color lateral line patterns and the diagonal line patterns Lcc, Lkk, Lyy, and Lmm are correspondingly calculated, respectively. Subsequently, based on these lengths of intervals calculated in this way, differences between the length of the interval between the reference component color K and each of the respective lengths of the intervals between the other component colors C, Y, and M are calculated. That is, the difference Lkk-Lyy between the lengths of the respective intervals of K and Y, the difference Lkk-Lmm between the lengths of the respective intervals of K and M, and the difference Lkk-Lcc between the lengths of the respective intervals of K and C are calculated. When misalignment occurs in the main scanning direction, since the diagonal pattern inclines by a given angle from the main scanning direction, an interval between the lateral line pattern and the diagonal pattern either expands or narrows greatly more than that of the reference component color. Accordingly, these differences can be regarded (i.e., determined) as registration misalignments in the main scanning direction.

The skew misalignment amount and the magnification error in the main scanning direction can be obtained based on a combination of detection results of the respective optical sensors 150*a* to 150*c*. That is, the skew misalignment amount can be obtained by calculating an amount of difference between sub-scanning registration misalignments respectively calculated based on the detection results of the optical sensors 150*a* and 150*c*. The main scanning direction magnification error can be also obtained by calculating an amount of difference between sub-scanning registration misalignments respectively calculated based on detection results of the optical sensors 150*a* and 150*b*, while calculating an amount of difference between the sub-scanning registration misalignments respectively calculated based on detection results of the optical sensors 150*b* and 150*c* at the same time as well.

Subsequently, based on the calculated various amounts of misalignments, a multi-color misalignment amount adjusting process is implemented to adjust the various amounts of misalignments calculated in this way. Then, based on the adjusted amount of misalignment, an image correction process is implemented to correct an image formation processing condition under which component color images are formed on the intermediate transfer belt 8. For example, in the image correction process, a light emitting time when each of the light beams Y to C is emitted to corresponding one of the respective photoconductive members 120*y* to 120*c* is changed in accordance with the adjusted misalignment amount. Otherwise, an inclination of a reflective mirror that reflects the light beam can be also changed in accordance therewith as well. To adjust the inclination of the reflective mirror, it can be driven by a stepping motor attached to the reflective mirror in the optical writing system. Yet otherwise, image data itself can be changed in accordance with the adjusted amount of misalignment as well.

Figure 9:
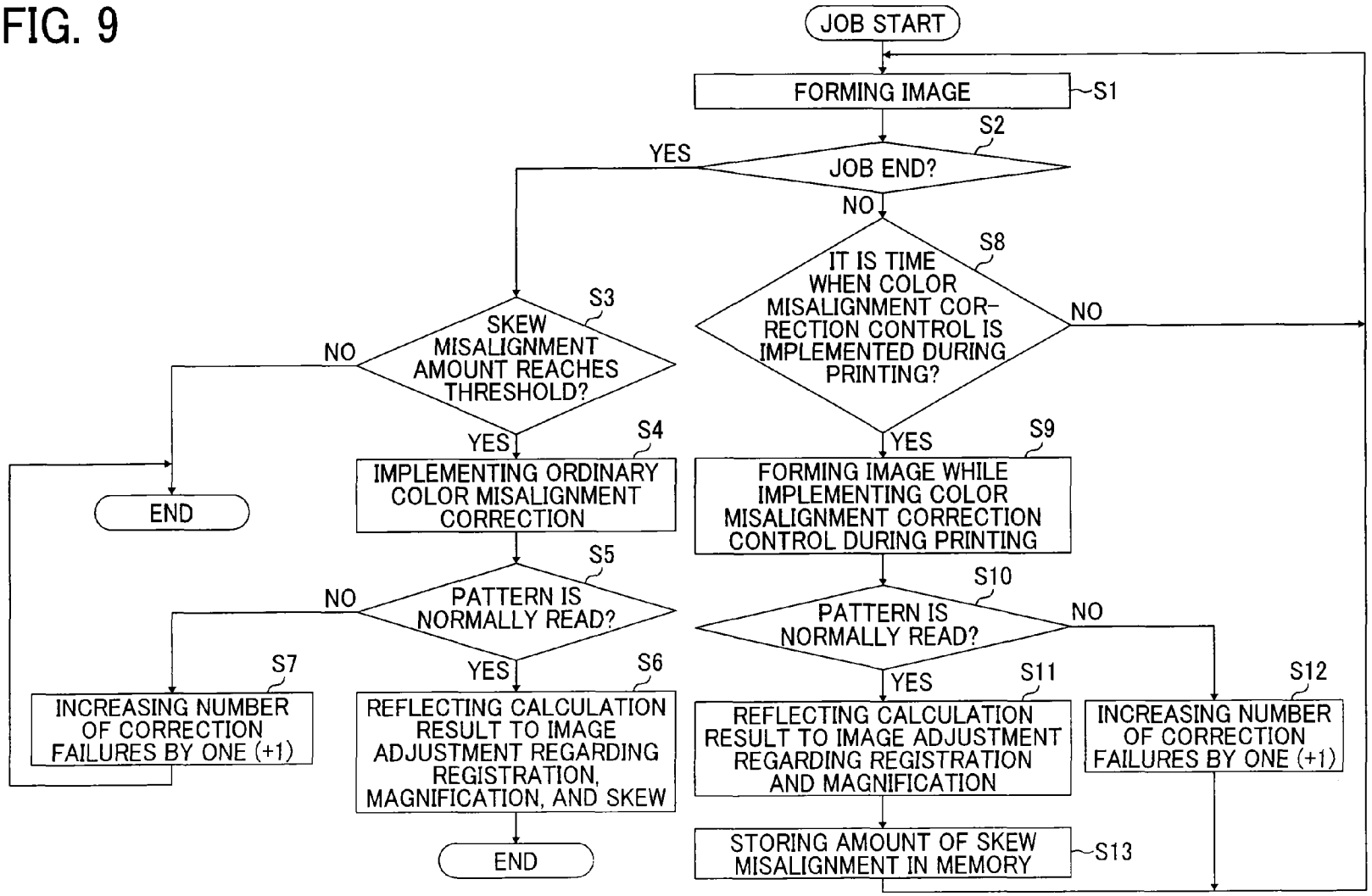
FIG. 9 is a flowchart illustrating an exemplary image adjustment control process executed in the image forming apparatus of FIG. 1 according to one embodiment of the present invention.

Of the multi-color misalignment amounts, the main scanning registration misalignment and the sub-scanning registration misalignment can be corrected by changing a writing time of the laser beam onto the photoconductive member. Similarly, of the multi-color misalignment amounts, the main scanning magnification error can be digitally corrected by changing a frequency of pixel clocks. Because of this, these multi-color misalignment amounts can be adjusted when calculation of the misalignment amount is completed even during the print job and an interval between sheets passes through a transfer station. By contrast, however, the skew misalignment is necessary adjusted to align images on each of the component color photoconductive members by mechanically operating a mirror or the like disposed in the optical path by using a motor or the like. Accordingly, the skew misalignment cannot be adjusted in such a short time when the interval between sheets in a process of printing passes through the transfer station. Because of this, in the multi-color misalignment correction control executed during the print job, a skew misalignment adjustment process cannot be continuously conducted immediately after an amount of skew misalignment is calculated. Accordingly, the skew misalignment adjustment process is necessarily conducted when correction control is implemented during the system idling time. Now, an exemplary image adjustment control process (i.e., sequence) according to one embodiment of the present invention is described with reference to FIG. 9. That is, FIG. 9 illustrates an exemplary image adjustment control process with a flowchart according to one embodiment of the present invention. First of all, in the image forming apparatus, when a print job start signal is output from the print job control unit 252 to the control unit 250, the control unit 250 starts an image formation process in step S1. It is determine in step S whether or not the print job is completed based on the information transmitted from the print job control unit 252 to the control unit 250. If the print job is completed (Yes, in step S2), the process goes to step S3. By contrast, if the print job is not completed (No, in step S2), the process goes to step S8.

Specifically, when it is determined in step S2 that the print job is completed (Yes, in step S2), it is further determined in step S3 by the adjustment executing time control unit 250*e* if the amount of skew misalignment reaches a prescribed threshold A or more. If it is determined by the adjustment executing time control unit 250*e* that the amount of skew misalignment reaches the prescribed threshold A or more (Yes, in step S3), the process goes to step S4. By contrast, if it is determined by the adjustment executing time control unit 250*e* that the amount of skew misalignment is below the prescribed threshold A (No, in step S3), the process ends. Here, the threshold A is stored in a region of a memory unit 253 and can be rewritten by accessing the region from an outside thereof while implementing a special operation, such as inputting a password, etc.

In step S4, the adjustment unit 250*c* sets an system idling period multi-color misalignment correction control mode as a multi-color misalignment correction control mode, and the test pattern forming unit 250*a* forms multiple color misalignment detection test pattern images 42*a*, 42*b*, and 42*c* by controlling the optical writing unit 7 and the drive sources for the respective photoconductive members 1Y, 1M, 1C, and 1K. Subsequent to step S4, these multiple color misalignment detection test pattern images 42*a*, 42*b*, and 42*c* formed in this way are read by the optical sensing unit 150, and it is determined by the test pattern detecting unit 251 whether or not these multiple color misalignment detection test pattern images 42*a*, 42*b*, and 42*c* are normally (i.e., successfully) read in step S5. When it is determined by the test pattern detecting unit 251 that the multiple color misalignment detection test pattern images 42*a*, 42*b*, and 42*c* are normally (i.e., successfully) read (Yes, in step S5), the process goes to step S6. By contrast, when it is determined by the test pattern detecting unit 251 that the multiple color misalignment detection test pattern images 42*a*, 42*b*, and 42*c* are not normally (i.e., successfully) read (No, in step S5), the process goes to step S7, and the number of correction failures stored in the memory unit 253 is increased by one. Subsequently, the process ends. Specifically, in step S6, the misalignment amount calculation unit 250*b* calculates an amount of registration misalignment, an amount of magnification misalignment, and an amount of skew misalignment as well, and subsequently, the adjustment unit 250*c* conducts an image adjustment process to adjust the registration misalignment, the magnification misalignment, and the skew misalignment as well based on the calculation results. The operation is then completed.

By contrast, when it is determined in step S2 that the print job is not completed (No, in step S2), it is further determined by the adjustment executing time control unit 250*e* whether or not it is a time to perform multi-color misalignment correction control during the print job in step S8. When it is determined by the adjustment executing time control unit 250*e* that it is a time to perform multi-color misalignment correction control in step S8 (Yes, in step S8), the process goes to step S9. By contrast, when it is determined by the adjustment executing time control unit 250*e* that it is not a time to perform multi-color misalignment correction control in step S8 (No, in step S8), the process returns to step S1. Specifically, in step S9, the adjustment unit 250*c* sets a print job period multi-color misalignment correction control mode as a multi-color misalignment correction control mode, and the test pattern forming unit 250*a* forms multiple color misalignment detection test pattern images 42*a* and 42*c* by controlling the optical writing unit 7 and the drive sources for the respective photoconductive members 1Y, 1M, 1C, and 1K as well.

Subsequent to step S9, the multiple color misalignment detection test pattern images 42*a* and 42*c* formed as described above are read by the optical sensing unit 150. It is then determined by the test pattern detecting unit 251 whether or not these multiple color misalignment detection test pattern images 42*a*, 42*b*, and 42*c* are normally (i.e., successfully) read in step S10. When it is determined by the test pattern detecting unit 251 that the multiple color misalignment detection test pattern images 42*a*, 42*b*, and 42*c* are normally (i.e., successfully) read (Yes, in step S10), the process goes to step S11. By contrast, when it is determined by the test pattern detecting unit 251 that the multiple color misalignment detection test pattern images 42*a* to 42*c* are not normally (i.e., successfully) read (No, in step S10), the process goes to step S12, and the number of correction failures stored in the memory unit 253 is increased by one. The operation is then completed (i.e., the process ends). Specifically, in step S11, the misalignment amount calculation unit 250*b* calculates an amount of registration misalignment, an amount of magnification misalignment, and an amount of skew misalignment as well, and the adjustment unit 250*c* then conducts image adjustment regarding the registration misalignment and the magnification misalignment based on the calculation results. Subsequent to step S11, the amount of skew misalignment calculated in step S11 is stored in the memory unit 253 in step S13. Subsequently, the process returns to step S1.

In the past, when color skew correction control is conducted during a print job but a skew misalignment amount calculated by the misalignment amount calculation unit 250*b* is not stored in the memory unit 253, the determination if the skew misalignment amount exceeds the prescribed threshold is only implemented when the multi-color misalignment correction control is performed during the system idling time. By contrast, however, according to one embodiment of the present invention, since color skew correction control is conducted during a print job while a skew misalignment amount calculated by the misalignment amount calculation unit 250*b* is stored in the memory unit 253 as well, the determination if the skew misalignment amount exceeds the threshold can be implemented immediately after the end of the print job. Hence, since the multi-color misalignment correction control is immediately performed to correct the skew misalignment amount when the skew misalignment amount exceeds the prescribed threshold, the skew misalignment can be prevented from growing while forming a high-quality image with less multi-color misalignment. Further, according to one embodiment of the present invention, effectiveness of the image formation process can be more desirably maintained when compared to a situation in which an interval between executions of multi-color misalignment correction control during the system idling time is shortened in the same way. That is, according to one embodiment of the present invention, even though the interval between executions of multi-color misalignment correction control during the system idling time is the same as in the past, the multi-color misalignment correction control is additionally performed during the system idling time only when the skew misalignment amount calculated in the multi-color misalignment correction control executed during the print job exceeds the threshold.

Figures 10, 10A, 10B:
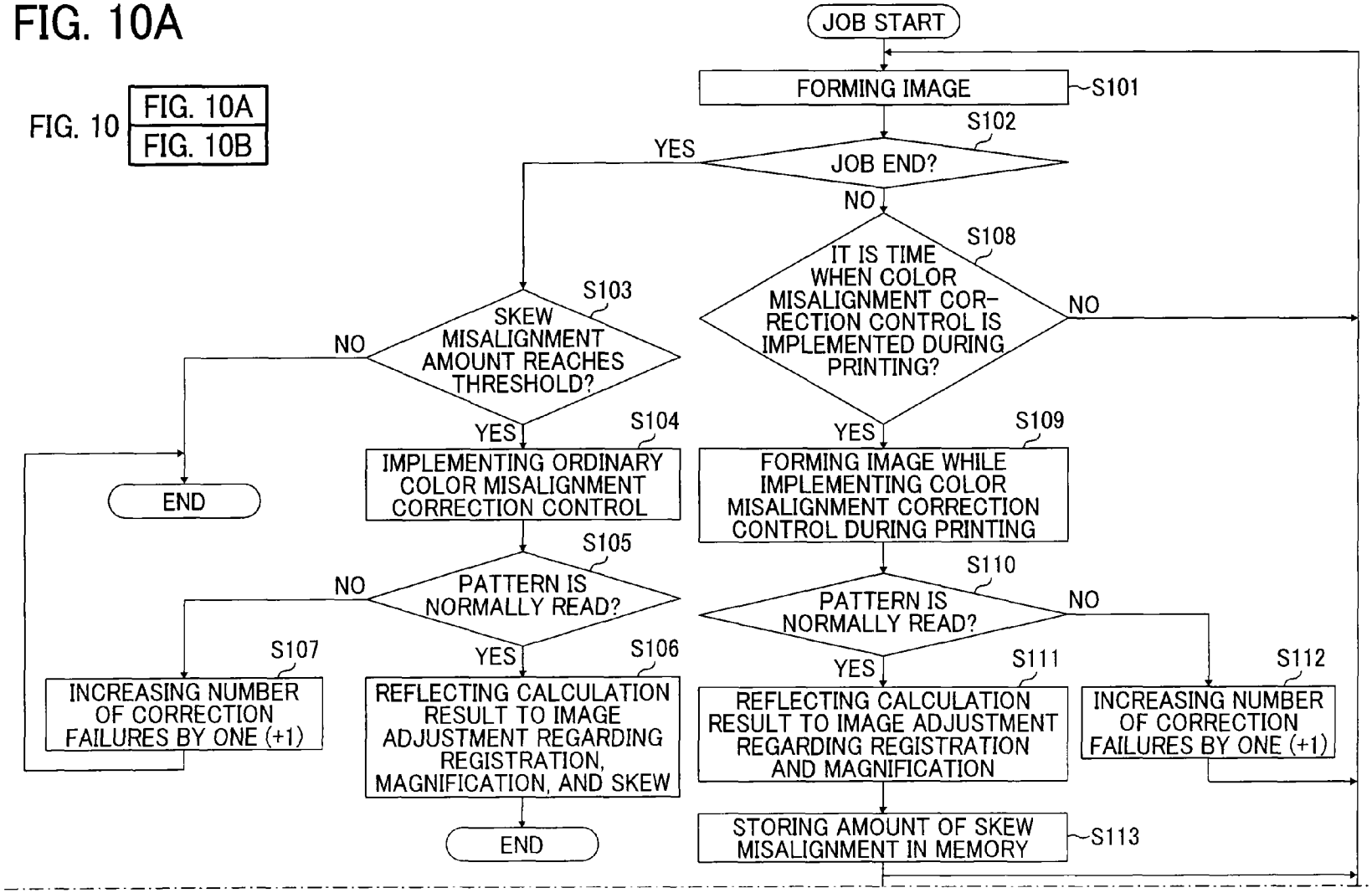
FIGS. 10A and 10B (collectively referred to as FIG. 10) are flowcharts illustrating another exemplary image adjustment control process executed in the image forming apparatus of FIG. 1 according to one embodiment of the present invention.
Figure 10B:
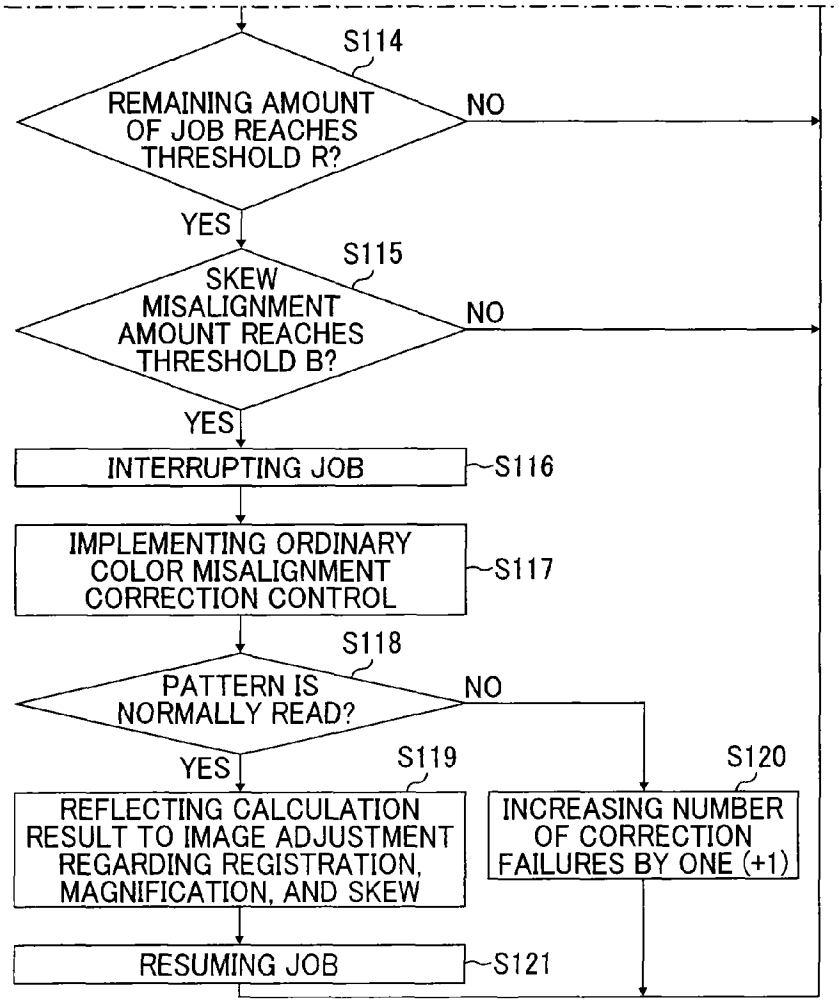

Now, an exemplary modification of an image adjustment control process is described herein below with reference to FIG. 10. Specifically, FIG. 10 illustrates the exemplary modification of an image adjustment control process with a flowchart. As shown there, in an image forming apparatus, first of all, when the print job control unit 252 outputs a print job start signal to the control unit 250, the control unit 250 starts an image formation process in step S101. It is then determined in step S102 whether or not the print job is completed based on the information transmitted from the print job control unit 252 to the control unit 250. When the print job is completed (Yes, in step S102), the process goes to step S103. By contrast, when the print job is not completed (No, in step S102), the process goes to step S108.

When it is determined in step S102 that the print job ends, it is further determined in step S103 by the adjustment executing time control unit 250*e* if an amount of skew misalignment reaches the prescribed threshold A or more. When the amount of skew misalignment reaches the prescribed threshold A or more (Yes, in step S103), the process goes to step S104. By contrast, when the amount of skew misalignment does not reach the prescribed threshold A or more (No, in step S103), the process ends. Here, the prescribed threshold A is stored in a region of the memory unit 253 and can be rewritten by accessing the region from an outside thereof while implementing a special operation, such as inputting a password, etc. Further, since there exist various types of image forming apparatuses from a high-end machine to a low-end machine, the threshold may be set depending on demands or needs of end users.

In step S104, the adjustment unit 250*c* sets an system idling period multi-color misalignment correction control mode as a multi-color misalignment correction control mode, and the test pattern forming unit 250*a* forms multiple color misalignment detection test pattern images 42*a*, 42*b*, and 42*c* by controlling the optical writing unit 7 and the drive sources for the respective photoconductive members 1Y, 1M, 1C, and 1K. Subsequent to step S104, the multiple color misalignment detection test pattern images 42*a*, 42*b*, and 42*c* formed as described above are read by the optical sensing unit 150. It is then determined by the test pattern detecting unit 251 whether or not these multiple color misalignment detection test pattern images 42*a*, 42*b*, and 42*c* are normally (i.e., successfully) read in step S105. When it is determined by the test pattern detecting unit 251 that the multiple color misalignment detection test pattern images 42*a*, 42*b*, and 42*c* are normally (i.e., successfully) read (Yes, in step S105), the process goes to step S106. By contrast, when it is determined by the test pattern detecting unit 251 that the multiple color misalignment detection test pattern images 42*a*, 42*b*, and 42*c* are not normally (i.e., successfully) read (No, in step S105), the process goes to step S107, and the number of correction failures stored in the memory unit 253 is increased by one. Subsequently, the process ends. In step S106, the misalignment amount calculation unit 250*b* calculates an amount of registration misalignment, an amount of magnification misalignment, and an amount of skew misalignment as well. Subsequently, the adjustment unit 250*c* conducts image adjustment regarding the registration misalignment, the magnification misalignment, and the skew misalignment based on the calculation results.

By contrast, when it is determined in step S102 that the print job is not completed (No, in step S102), it is further determined by the adjustment executing time control unit 250*e* whether or not it is a time to perform multi-color misalignment correction control during the print job in step S108. When it is determined by the adjustment executing time control unit 250*e* that it is a time to perform multi-color misalignment correction control in step S108 (Yes, in step S108), the process goes to step S109. By contrast, when it is determined by the adjustment executing time control unit 250*e* that it is not a time to perform multi-color misalignment correction control during the print job in step S108 (No, in step S108), the process returns to step S101. In step S109, the adjustment unit 250*c* sets a print job period multi-color misalignment correction control mode as a multi-color misalignment correction control mode, and the test pattern forming unit 250*a* then forms multiple color misalignment detection test pattern images 42*a* and 42*c* by controlling the optical writing unit 7 and the drive sources for the respective photoconductive members 1Y, 1M, 1C, and 1K.

Subsequent to step S109, the multiple color misalignment detection test pattern images 42*a* and 42*c* formed as described above are read by the optical sensing unit 150. It is then determined by the test pattern detecting unit 251 whether or not these multiple color misalignment detection test pattern images 42*a* and 42*c* are normally (i.e., successfully) read in step S110. When it is determined by the test pattern detecting unit 251 that the multiple color misalignment detection test pattern images 42*a* and 42*c* are normally (i.e., successfully) read (Yes, in step S110), the process goes to step S111. By contrast, when it is determined by the test pattern detecting unit 251 that the multiple color misalignment detection test pattern images 42*a* and 42*c* are not normally (i.e., successfully) read (No, in step S110), the process goes to step S112, and the number of correction failures stored in the memory unit 253 is increased by one. The process then returns to step S101. In step S111, the misalignment amount calculation unit 250*b* calculates an amount of registration misalignment, an amount of magnification misalignment, and an amount of skew misalignment as well, and the adjustment unit 250*c* conducts image adjustment only regarding the registration misalignment, the magnification misalignment based on the calculation results. Subsequent to step S111, the amount of skew misalignment calculated in step S111 is stored in the memory unit 253 in step S113.

Subsequent to step S113, it is determined in step S114 by the print job control unit 252 whether or not the number of remaining print job sheets reaches a prescribed threshold R or more. When it is determined that the number of remaining print job sheets reaches the prescribed threshold R or more, the process goes to step S115. By contrast, when it is determined in step S114 by the print job control unit 252 that the number of remaining print job sheets does not reach the prescribed threshold R or more, the process returns to step S101. Here, the threshold R is stored in a region of a memory unit 253 and can be rewritten by accessing the region from an outside thereof while implementing a special operation such as inputting a password, etc. Further, it is determined in step S115 by the adjustment executing time control unit 250*e* whether or not the amount of skew misalignment stored in the memory unit 253 in step S113 reaches a prescribed threshold B or more. When it is determined in step S115 by the adjustment executing time control unit 250*e* that the amount of skew misalignment stored in the memory unit 253 in step S113 reaches the prescribed threshold B or more, this effect (i.e., information of the determination) is transmitted to the print job control unit 252 from the control unit 250. Subsequently, in step S16, the print job control unit 252 temporarily stops the print job. By contrast, when it is determined in step S115 by the adjustment executing time control unit 250*e* that the amount of skew misalignment stored in the memory unit 253 in step S113 does not reach the prescribed threshold B or more, the process returns to step S101. Here, the threshold R is stored in a region of a memory unit 253 and can be rewritten by accessing the region from an outside thereof while implementing a special operation such as inputting a password, etc.

Further, after the print job control unit 252 temporarily stops the print job in step S116, the adjustment unit 250*c* sets an system idling period multi-color misalignment correction control mode as a multi-color misalignment correction control mode, and the test pattern forming unit 250*a* forms multiple color misalignment detection test pattern images 42*a*, 42*b*, and 42*c* by controlling the optical writing unit 7 and the drive sources for the respective photoconductive members 1Y, 1M, 1C, and 1K. Subsequent to step S117, the multiple color misalignment detection test pattern images 42*a*, 42*b*, and 42*c* formed in this way are read by the optical sensing unit 150, and it is determined by the test pattern detecting unit 251 whether or not these multiple color misalignment detection test pattern images 42*a*, 42*b*, and 42*c* are normally (i.e., successfully) read in step S118. When it is determined by the test pattern detecting unit 251 that the multiple color misalignment detection test pattern images 42*a*, 42*b*, and 42*c* are normally (i.e., successfully) read (Yes, in step S118), the process goes to step S119. By contrast, when it is determined by the test pattern detecting unit 251 that the multiple color misalignment detection test pattern images 42*a*, 42*b*, and 42*c* are not normally (i.e., successfully) read (No, in step S118), the process goes to step S120, and the number of correction failures stored in the memory unit 253 is increased by one. Subsequently, the process returns to step S101. In step S119, the misalignment amount calculation unit 250*b* calculates an amount of registration misalignment, an amount of magnification misalignment, and an amount of skew misalignment as well, and the adjustment unit 250*c* conducts image adjustment regarding the registration misalignment, the magnification misalignment, and the skew misalignment based on the calculation results. Subsequent to step S119, information of the effect of completion of the an image adjustment process is transmitted to the print job control unit 252 from the control unit 250 the print job control unit 252 then resumes the print job in step S121. The process then returns to step S101.

Here, in the process shown in FIG. 9, the color system idling period correction control runs after the end of the print job even when the skew misalignment accumulates and grows during the print job. By contrast, however, in the process shown in FIG. 10, the color system idling period correction control is implemented while interrupting the print job when the skew misalignment accumulates and grows during the print job. Because of this, when a print job necessitating the large number of sheets is to be implemented, the process shown in FIG. 10 can more greatly reduce the multi-color misalignment than the process as described with reference to FIG. 9. Meanwhile, the process shown in FIG. 10 needs a longer system downtime than that of FIG. 9. Accordingly, to resolve such a problem, the threshold B desirably amounts to a level not to frequently interrupt the print job in the process shown in FIG. 10. For example, the threshold B is set greater than the threshold A or the like.

According to one embodiment of the present invention, high-quality images can be obtained while reducing multi-color misalignment and maintaining effectiveness of an image formation process as well. That is, according to one embodiment of the present invention, although the skew misalignment correction needs relatively a long time, the image formation process can be continuously effective. In addition, the skew misalignment can be prevented from growing, while forming a high-quality image with less multi-color misalignment.

That is, an image forming apparatus includes multiple latent image bearers to bear latent images thereon, respectively; multiple latent image writing units to write multiple latent images and multiple color misalignment detection test pattern images on the multiple latent image bearers, respectively; and multiple developing devices to render the multiple latent images and multiple color misalignment detection test pattern images borne on the multiple latent image bearers visible with toner of component colors, respectively. Multiple transfer units are also provided in the novel image forming apparatus to transfer and superimpose visible images rendered visible by the multiple developing devices and borne on the multiple latent image bearers, respectively, onto either an intermediate transfer member or a recording medium; multiple test pattern image detectors to detect the multiple color misalignment detection test pattern images transferred from the multiple latent image bearers onto either the intermediate transfer member or the recording medium, and the multiple test pattern image detectors outputting position readings of the multiple color misalignment detection test pattern images. Further included in the novel image forming apparatus are a multi-color misalignment calculator to calculate an amount of multi-color misalignment of the multiple color misalignment detection test pattern images including skew misalignment thereof based on the position readings outputted from the multiple test pattern image detectors; and an image formation condition adjusting unit to change an image formation condition in accordance with the amount of multi-color misalignment of the multiple color misalignment detection test pattern images calculated by the multi-color misalignment calculator. Yet further included in the novel image forming apparatus are a process control unit to initiate first and second multi-color misalignment correction control modes to correct multi-color misalignment of the multiple color misalignment detection test pattern images by executing a skew misalignment correction process during a system idling time period to correct the skew misalignment and a misalignment correction process other than the skew misalignment correction process during an image forming operation time period, respectively; and a memory to store the amount of skew misalignment calculated by the multi-color misalignment calculator when the process control unit initiates the second multi-color misalignment correction control mode while excluding the skew misalignment correction process. The process control unit initiates the first multi-color misalignment correction control mode to execute the skew misalignment correction process when the amount of skew misalignment stored in the memory reaches a prescribed threshold, and the multiple latent image writing units correct the multi-color misalignment in accordance with the image formation condition changed by the image formation condition adjusting unit in the first and second multi-color misalignment correction control modes.

Hence, even if multi-color misalignment correction control is executed without correcting skew misalignment during the print job, at least the skew misalignment amount is calculated and is then stored in the memory unit 253 acting as a memory, for example. Accordingly, a determination if an amount of skew misalignment reaches the prescribed threshold can be realized even when the multi-color misalignment correction control is executed without the skew misalignment correction. Further, the control unit 250 executes multi-color misalignment correction control including skew misalignment correction when the amount of skew misalignment stored in the memory unit 253 reaches the prescribed threshold. Furthermore, the control unit 250 executes the skew misalignment correction when the amount of skew misalignment stored in the memory unit 253 reaches the prescribed threshold.

According to another embodiment of the present invention, although the skew misalignment correction needs relatively a long time, the image formation process. In addition, the skew misalignment can be more highly likely continuously effective highly likely prevented from growing while forming a high-quality image with less component multi-color misalignment. Specifically, even when print jobs are continuously executed, the image formation process can be more highly likely continuously effective. That is, the process control unit initiates the first multi-color misalignment correction control mode including the skew misalignment correction process to correct the skew misalignment instead of the second multi-color misalignment correction control mode when the process control unit determines that the amount of skew misalignment calculated by the multi-color misalignment calculator reaches a prescribed threshold during execution the second multi-color misalignment correction control mode and the print job is completed.

According to yet another embodiment of the present invention, although the skew misalignment correction needs relatively a long time, the image formation process can be more highly likely continuously effective. In addition, the skew misalignment can be more highly likely prevented from growing while forming a high-quality image with less component multi-color misalignment. Specifically, when the skew misalignment correction is scheduled only after the end of the print job as in the above-described second embodiment and the skew misalignment amount has already reached the prescribed threshold but a large number of image formations on multiple sheets remain uncompleted, a large number of images with great multi-color misalignment due to the skew misalignment are necessarily formed. However, according to another embodiment of the present invention, since the skew misalignment is corrected while interrupting the print job in such a situation, a large number of images with large multi-color misalignment due to the skew misalignment can be prevented from being necessarily formed. That is, a print job control unit is provided to control a print job The process control unit instructs the print job control unit to interrupt a current print job to conduct the first multi-color misalignment correction control mode and correct the skew misalignment when the amount of skew misalignment calculated by the multi-color misalignment calculator reaches a first prescribed threshold during the second multi-color misalignment correction control mode and a prescribed number of images to be formed on recording media remains in the current print job. The process control unit instructs the print job control unit to resume the print job when the first multi-color misalignment correction control mode to correct the skew misalignment is completed.

According to yet another embodiment of the present invention, although the skew misalignment correction needs relatively a long time, the image formation process can be more highly likely continuously effective. In addition, the skew misalignment can be more highly likely prevented from growing while forming a high-quality image with less component multi-color misalignment. Specifically, according to yet another embodiment of the present invention, since a rotary driving motor for driving a polygon mirror disposed in the optical writing unit 7 or the like is controlled to adjust scanning lines based on a result of calculation of the skew misalignment amount obtained when the multi-color misalignment correction control is executed, component multi-color misalignment occurring due to the skew misalignment can be effectively reduced while improving image quality. That is, multiple drive sources are provided to drive the respective latent image writing units. The process control unit transmits a prescribed instruction to at least one of applicable drive sources to correct skew misalignment in accordance with the amount of skew misalignment calculated by the multi-color misalignment calculator. Further, the at least one of applicable latent image writing units changes a position or an inclination of a scanning line of its own based on the instruction transmitted from the process control unit.

According to yet another embodiment of the present invention, although the skew misalignment correction needs relatively a long time, the image formation process can be more highly likely continuously effective while preventing the skew misalignment from growing and thereby forming a high-quality image with less component multi-color misalignment. Further, although there generally exists various types of image forming apparatuses from a high-end machine to a low-end machine, and image quality is sometimes expected to be variable depending on usage of printed materials such that a priority is given to a printing speed not to an image quality and, by contrast, a priority is given to the image quality not to the printing speed as well, the image formation process can be more highly likely continuously effective while preventing the skew misalignment from growing and thereby forming a high-quality image with less component multi-color misalignment. That is, the prescribed threshold is stored in a prescribed region of the memory and is changeable by allowing access from an outside thereof when a special operation is provided thereto. That is, since the threshold is rendered variable, an optimal threshold can be optionally set in accordance with the image quality sought by a user as well.

Numerous additional modifications and variations of the present invention are possible in light of the above teachings. It is therefore to be understood that within the scope of the appended claims, the present invention may be executed otherwise than as specifically described herein. For example, the image forming apparatus is not limited to the above-described various embodiments and may be altered as appropriate. Further, the method of forming an image is not limited to the above-described various embodiments and may be altered as appropriate. For example, steps of the method can be altered as appropriate.

What is claimed is:

1. An image forming apparatus comprising:

multiple latent image bearers to bear latent images;

multiple latent image writing units to write multiple latent images and multiple color misalignment detection test pattern images on the multiple latent image bearers;

multiple developing devices to render the multiple latent images and multiple color misalignment detection test pattern images borne on the multiple latent image bearers visible with toner of component colors;

multiple transfer units to transfer and superimpose the visible images from the multiple latent image bearers onto either an intermediate transfer member or a recording medium;

multiple test pattern image detectors to detect the multiple color misalignment detection test pattern images transferred from the multiple latent image bearers onto either the intermediate transfer member or the recording medium, the multiple test pattern image detectors outputting position readings of the multiple color misalignment detection test pattern images;

a multi-color misalignment calculator to calculate an amount of multi-color misalignment of the multiple color misalignment detection test pattern images based on the position readings outputted from the multiple test pattern image detectors, the amount of multi-color misalignment including an amount of skew misalignment of each of multiple color misalignment detection test pattern images;

an image formation condition adjusting unit to change an image formation condition of the image forming apparatus in accordance with the amount of multi-color misalignment of each of the multiple color misalignment detection test pattern images calculated by the multi-color misalignment calculator;

a process control unit to run a first multi-color misalignment correction control mode and a second multi-color misalignment correction control mode to correct the multi-color misalignment of the multiple color misalignment detection test pattern images, the first multi-color misalignment correction control mode executing a skew misalignment correction process during a system idling time period to correct the skew misalignment, the second multi-color misalignment correction control mode executing a misalignment correction process other than the skew misalignment correction process during an image forming operation time period; and a memory to store the amount of skew misalignment calculated by the multi-color misalignment calculator when the process control unit initiates the second multi-color misalignment correction control mode while excluding the skew misalignment correction process, the process control unit initiating the first multi-color misalignment correction control mode to execute the skew misalignment correction process when determining, in response to a print job being completed, that the amount of skew misalignment stored in the memory reaches a first prescribed threshold, the process control unit instructing interruption of a current print job to conduct the first multi-color misalignment correction control mode and correct the skew misalignment when the amount of skew misalignment calculated by the multi-color misalignment calculator reaches a second prescribed threshold greater than the first prescribed threshold, and the multiple latent image writing units correcting the multi-color misalignment in accordance with the image formation condition changed by the image formation condition adjusting unit in the first and second multi-color misalignment correction control modes.

2. The image forming apparatus as claimed in claim 1, wherein the process control unit initiates the first multi-color misalignment correction control mode including the skew misalignment correction process to correct the skew misalignment instead of the second multi-color misalignment correction control mode when the process control unit determines that the amount of skew misalignment calculated by the multi-color misalignment calculator reaches the first prescribed threshold and the print job is completed.

3. The image forming apparatus as claimed in claim 1, further comprising a print job control unit to control the print job, wherein the process control unit instructs the print job control unit to interrupt the current print job to conduct the first multi-color misalignment correction control mode and correct the skew misalignment when the amount of skew misalignment calculated by the multi-color misalignment calculator reaches the second prescribed threshold greater than the first prescribed threshold and a prescribed number of images to be formed on recording media remains in the second multi-color misalignment correction control mode, and wherein the process control unit instructs the print job control unit to resume the print job when the first multi-color misalignment correction control mode to correct the skew misalignment is completed.

4. The image forming apparatus as claimed in claim 1, further comprising multiple drive sources to drive the respective latent image writing units, wherein the process control unit transmits a prescribed instruction to at least one of applicable drive sources to correct skew misalignment in accordance with the amount of skew misalignment calculated by the multi-color misalignment calculator, and wherein the at least one of applicable latent image writing units changes a position or an inclination of a scanning line of its own based on the instruction transmitted from the process control unit.

5. The image forming apparatus as claimed in claim 1, wherein the first prescribed threshold is stored in a prescribed region of the memory and is changeable, the prescribed region of the memory being externally accessible.

6. A method of forming an image comprising the steps of:

starting a print job;

writing multiple latent images on multiple latent image bearers with multiple latent image writers;

developing the multiple latent images borne on the multiple latent image bearers into visible images with multiple developing devices;

transferring and superimposing the visible images with multiple transfer devices from the multiple latent image bearers onto either an intermediate transfer member or a recording medium;

timely forming multiple color misalignment detection test pattern images composed of component color images on the multiple latent image bearers;

transferring the multiple color misalignment detection test pattern images composed of component color images onto either the intermediate transfer member or the recording medium from the multiple latent image bearers;

optically detecting the multiple color misalignment detection test pattern images with circuitry on either the intermediate transfer member or the recording medium;

generating position readings of the multiple color misalignment detection test pattern images with the circuitry;

calculating an amount of multi-color misalignment of each of the multiple color misalignment detection test pattern images borne on either the intermediate transfer member or the recording medium with the circuitry based on the position readings outputted from the circuitry, the amount of multi-color misalignment including an amount of registration misalignment and an amount of skew misalignment;

changing an image formation condition per component color with the circuitry in accordance with the amount of multi-color misalignment of each of the multiple color misalignment detection test pattern images calculated by the circuitry;

initiating a second multi-color misalignment correction control mode including a registration misalignment correction process and excluding a skew misalignment correction process during the print job to correct the registration misalignment of the multiple color misalignment detection test pattern images;

storing the amount of skew misalignment calculated by the circuitry in a memory during the second multi-color misalignment correction control mode;

determining, with the circuitry, in response to the print job being completed, if the amount of skew misalignment stored in the memory exceeds a prescribed first threshold;

initiating a first multi-color misalignment correction control mode including the skew misalignment correction process to correct the skew misalignment of the multiple color misalignment detection test pattern images when determination of the step of determining if the amount of skew misalignment stored in the memory exceeds the prescribed first threshold is positive;

interrupting a current print job to start the step of initiating a first multi-color misalignment correction control mode including the skew misalignment correction process to correct the skew misalignment of the multiple color misalignment detection test pattern images, when the amount of skew misalignment stored in the memory exceeds a prescribed second threshold greater than the first prescribed threshold; and driving multiple latent image writers in accordance with the image formation condition changed by the circuitry during the first and second multi-color misalignment correction control modes.

7. The method as claimed in claim 6, further comprising the step of stopping the print job when determination of the step of determining if the amount of skew misalignment stored in the memory exceeds the prescribed first threshold is positive, wherein the step of initiating the first multi-color misalignment correction control mode including the skew misalignment correction process to correct the skew misalignment starts immediately after the step of stopping the print job.

8. The method as claimed in claim 6, further comprising the steps of:

determining if the amount of skew misalignment stored in the memory exceeds the prescribed second threshold greater than the first threshold;

determining if a prescribed number of images to be formed on recording media in the current print job remains when the step of determining if the amount of skew misalignment stored in the memory exceeds the prescribed second threshold greater than the first threshold is positive;

interrupting the current print job to start the step of initiating a first multi-color misalignment correction control mode including the skew misalignment correction process to correct the skew misalignment of the multiple color misalignment detection test pattern images, when it is determined that the amount of skew misalignment stored in the memory exceeds the prescribed second threshold greater than the first prescribed threshold and the prescribed number of images to be formed on the recording media in the current print job remains; and resuming the print job when the step of interrupting the current print job to start the step of initiating a first multi-color misalignment correction control mode including the skew misalignment correction process to correct the skew misalignment is terminated.

9. The method as claimed in claim 6, wherein the step of driving multiple latent image writers in accordance with the image formation condition changed by the circuitry during the first and second multi-color misalignment correction control modes includes the sub steps of:

transmitting instructions to multiple drive sources for driving the multiple latent image writers to correct skew misalignment in accordance with a detected amount of skew misalignment; and adjusting either positions or inclinations of scanning lines of the multiple latent image writers based on the instructions.

10. The method as claimed in claim 6, further comprising the steps of:

storing the first prescribed threshold of skew misalignment in a prescribed region of the memory; and allowing access from an outside thereof to change the prescribed first threshold.

11. An image forming apparatus comprising:

multiple latent image bearers to bear latent images;

multiple latent image writers to write multiple latent images and multiple color misalignment detection test pattern images on the multiple latent image bearers;

multiple developing devices to render the multiple latent images and multiple color misalignment detection test pattern images borne on the multiple latent image bearers visible with toner of component colors;

multiple transfer devices, including rollers, to transfer and superimpose the visible images from the multiple latent image bearers onto either an intermediate transfer member or a recording medium;

a memory; and circuitry configured to detect the multiple color misalignment detection test pattern images transferred from the multiple latent image bearers onto either the intermediate transfer member or the recording medium, the multiple test pattern image detectors outputting position readings of the multiple color misalignment detection test pattern images, calculate an amount of multi-color misalignment of the multiple color misalignment detection test pattern images based on the position readings outputted from the multiple test pattern image detectors, the amount of multi-color misalignment including an amount of skew misalignment of each of multiple color misalignment detection test pattern images, change an image formation condition of the image forming apparatus in accordance with the amount of multi-color misalignment of each of the multiple color misalignment detection test pattern images calculated by the circuitry, and run a first multi-color misalignment correction control mode and a second multi-color misalignment correction control mode to correct the multi-color misalignment of the multiple color misalignment detection test pattern images, the first multi-color misalignment correction control mode executing a skew misalignment correction process during a system idling time period to correct the skew misalignment, the second multi-color misalignment correction control mode executing a misalignment correction process other than the skew misalignment correction process during an image forming operation time period, wherein the memory is configured to store the amount of skew misalignment calculated by the circuitry when the circuitry initiates the second multi-color misalignment correction control mode while excluding the skew misalignment correction process, the circuitry is configured to initiate the first multi-color misalignment correction control mode to execute the skew misalignment correction process when determining, in response to a print job being completed, that the amount of skew misalignment stored in the memory reaches a first prescribed threshold, the circuitry is configured to instruct interruption of a current print job to conduct the first multi-color misalignment correction control mode and correct the skew misalignment when the amount of skew misalignment calculated by the circuitry reaches a second prescribed threshold greater than the first prescribed threshold, and the multiple latent image writers correct the multi-color misalignment in accordance with the image formation condition changed by the circuitry in the first and second multi-color misalignment correction control modes.

* * * * *